US008834332B2

(12) United States Patent
Campanaro et al.

(10) Patent No.: US 8,834,332 B2
(45) Date of Patent: Sep. 16, 2014

(54) COLLAPSIBLE INCLINABLE EXERCISE DEVICE AND METHOD OF USING SAME

(75) Inventors: Thomas J. Campanaro, Rancho Santa Fe, CA (US); Dan McCutcheon, San Diego, CA (US)

(73) Assignee: Total Gym Global Corp., San Diego, CA (US)

( * ) Notice: Subject to any disclaimer, the term of this patent is extended or adjusted under 35 U.S.C. 154(b) by 472 days.

(21) Appl. No.: 13/211,058

(22) Filed: Aug. 16, 2011

(65) Prior Publication Data

US 2012/0053028 A1 Mar. 1, 2012

Related U.S. Application Data

(60) Provisional application No. 61/377,638, filed on Aug. 27, 2010.

(51) Int. Cl.

| | |
|---|---|
| ***A63B 21/00*** | (2006.01) |
| ***A63B 21/068*** | (2006.01) |
| ***A63B 26/00*** | (2006.01) |
| ***A63B 23/04*** | (2006.01) |
| ***A63B 21/055*** | (2006.01) |
| ***A63B 23/035*** | (2006.01) |
| ***A63B 23/12*** | (2006.01) |
| ***A63B 23/02*** | (2006.01) |
| ***A63B 21/06*** | (2006.01) |

(52) U.S. Cl.

CPC ..... *A63B 21/1461* (2013.01); *A63B 21/156* (2013.01); *A63B 2225/09* (2013.01); *A63B 23/0494* (2013.01); *A63B 21/1469* (2013.01); *A63B 21/068* (2013.01); *A63B 2210/50* (2013.01); *A63B 2225/093* (2013.01); *A63B 21/0557* (2013.01); *A63B 23/03566* (2013.01); *A63B 23/12* (2013.01); *A63B 23/0205* (2013.01); *A63B 21/00072* (2013.01); *A63B 21/0613* (2013.01); *A63B 2021/0612* (2013.01)

USPC ..... 482/142; 482/95; 482/96; 482/131

(58) Field of Classification Search

CPC .. A63B 21/154; A63B 2210/50; A63B 22/20; A63B 22/201; A63B 22/203; A63B 21/1492; A63B 21/068; A63B 21/0552; A63B 22/0087; A63B 22/0023; A63B 21/0083; A61G 7/1042

USPC ..... 482/95–96, 123, 131, 133, 135, 142

See application file for complete search history.

(56) References Cited

U.S. PATENT DOCUMENTS 5,125,884 A * 6/1992 Weber et al. ..... 482/145
5,222,927 A 6/1993 Chang (Continued)

OTHER PUBLICATIONS

Notification, International Search Report and Written Opinion dated Mar. 28, 2012 for PCT/US2011/48758.

*Primary Examiner* — Stephen Crow
*Assistant Examiner* — Joshua Lee
(74) *Attorney, Agent, or Firm* — Stephen C. Beuerle; Procopio Cory Hargreaves & Savitch LLP

(57) ABSTRACT

An exercise device includes a vertical support member; an adjustable incline having a first end and a second end, the first end of the adjustable incline vertically movable with respect to the vertical support member for setting the incline of the adjustable incline, the adjustable incline including a top rail and a bottom rail pivotally coupled to each other at a first location; a strut with a first end and a second end, the first end of the strut being pivotally coupled to the vertical support member and the second end of the strut being pivotally coupled to the adjustable incline at a second location that is not the same as the first location; a user support platform movably attached to the adjustable incline; pulleys and one or more cables coupled to the adjustable incline and user support platform for movement of the support platform along the adjustable incline.

16 Claims, 25 Drawing Sheets

(56) References Cited

U.S. PATENT DOCUMENTS

| | | | | |
|---|---|---|---|---|
| 5,938,571 | A * | 8/1999 | Stevens | 482/96 |
| 5,967,955 | A | 10/1999 | Westfall | |
| 6,692,412 | B2 * | 2/2004 | Chen et al. | 482/96 |
| 6,921,355 | B2 | 7/2005 | Campanaro | |
| 6,981,932 | B1 | 1/2006 | Huang | |
| 7,179,207 | B2 * | 2/2007 | Gerschefske | 482/95 |
| 7,270,628 | B2 | 9/2007 | Campanaro | |
| 7,503,880 | B2 | 3/2009 | Campanaro | |
| 7,766,801 | B2 | 8/2010 | Campanaro | |
| 7,771,328 | B2 * | 8/2010 | Gerschefske | 482/95 |
| 7,803,095 | B1 * | 9/2010 | LaGree | 482/140 |
| 7,806,805 | B2 * | 10/2010 | Barufka et al. | 482/5 |
| 7,892,159 | B2 * | 2/2011 | McVay et al. | 482/142 |
| 8,033,970 | B2 | 10/2011 | Campanaro | |
| 8,033,971 | B2 | 10/2011 | Campanaro | |
| 8,562,492 | B2 * | 10/2013 | Gerschefske et al. | 482/95 |
| 2002/0132706 | A1 * | 9/2002 | Sleamaker | 482/51 |
| 2002/0183172 | A1 * | 12/2002 | Chen et al. | 482/95 |
| 2004/0166998 | A1 * | 8/2004 | Campanaro et al. | 482/95 |
| 2004/0235623 | A1 * | 11/2004 | Martinez | 482/94 |
| 2004/0248713 | A1 * | 12/2004 | Campanaro et al. | 482/123 |
| 2005/0159278 | A1 * | 7/2005 | McVay et al. | 482/142 |
| 2007/0111866 | A1 * | 5/2007 | McVay et al. | 482/95 |
| 2007/0142175 | A1 * | 6/2007 | Morgan et al. | 482/1 |
| 2007/0203004 | A1 * | 8/2007 | Campanaro et al. | 482/142 |
| 2008/0161173 | A1 | 7/2008 | Campanaro et al. | |
| 2008/0171643 | A1 * | 7/2008 | Baudhuin | 482/148 |
| 2009/0181834 | A1 | 7/2009 | Campanaro et al. | |
| 2010/0248911 | A1 * | 9/2010 | Myers | 482/96 |
| 2011/0009249 | A1 | 1/2011 | Campanaro | |
| 2012/0283079 | A1 * | 11/2012 | Solow et al. | 482/142 |

* cited by examiner

| Nominal | | Your Body Weight + weights added Kg | | | | | | | | | |
|---|---|---|---|---|---|---|---|---|---|---|---|
| % of BW | Level | 50 | 60 | 70 | 80 | 100 | 120 | 150 | 180 | 240 | 295 |
| | 26 | 70 | 68 | 67 | 66 | 64 | 63 | 62 | 61 | 61 | 60 |
| 65 | 25 | 68 | 66 | 65 | 64 | 62 | 61 | 60 | 59 | 59 | 58 |
| | 24 | 66 | 64 | 63 | 62 | 60 | 59 | 59 | 58 | 57 | 57 |
| 60 | 23 | 64 | 62 | 60 | 59 | 58 | 57 | 56 | 56 | 55 | 54 |
| | 22 | 61 | 59 | 58 | 57 | 56 | 55 | 54 | 53 | 52 | 52 |
| 55 | 21 | 58 | 57 | 55 | 55 | 53 | 52 | 52 | 51 | 50 | 50 |
| | 20 | 56 | 54 | 53 | 52 | 51 | 50 | 49 | 49 | 48 | 48 |
| 50 | 19 | 53 | 52 | 50 | 50 | 48 | 48 | 47 | 46 | 46 | 45 |
| | 18 | 51 | 49 | 48 | 47 | 46 | 45 | 45 | 44 | 43 | 43 |
| 45 | 17 | 48 | 46 | 45 | 45 | 44 | 43 | 42 | 42 | 41 | 41 |
| | 16 | 45 | 44 | 43 | 42 | 41 | 41 | 40 | 39 | 39 | 39 |
| 40 | 15 | 43 | 41 | 40 | 40 | 39 | 38 | 38 | 37 | 37 | 36 |
| | 14 | 40 | 39 | 38 | 37 | 36 | 36 | 35 | 35 | 34 | 34 |
| 35 | 13 | 37 | 36 | 35 | 35 | 34 | 33 | 33 | 33 | 32 | 32 |
| | 12 | 35 | 34 | 33 | 32 | 32 | 31 | 31 | 30 | 30 | 30 |
| 30 | 11 | 32 | 31 | 30 | 30 | 29 | 29 | 28 | 28 | 28 | 27 |
| | 10 | 29 | 29 | 28 | 27 | 27 | 26 | 26 | 26 | 25 | 25 |
| 25 | 9 | 27 | 26 | 25 | 25 | 24 | 24 | 24 | 23 | 23 | 23 |
| | 8 | 24 | 23 | 23 | 23 | 22 | 22 | 21 | 21 | 21 | 21 |
| 20 | 7 | 22 | 21 | 20 | 20 | 20 | 19 | 19 | 19 | 19 | 18 |
| | 6 | 19 | 18 | 18 | 18 | 17 | 17 | 17 | 17 | 16 | 16 |
| 15 | 5 | 16 | 16 | 16 | 15 | 15 | 15 | 14 | 14 | 14 | 14 |
| | 4 | 14 | 13 | 13 | 13 | 13 | 12 | 12 | 12 | 12 | 12 |
| 10 | 3 | 11 | 11 | 11 | 10 | 10 | 10 | 10 | 10 | 10 | 9 |
| | 2 | 8 | 8 | 8 | 8 | 8 | 8 | 7 | 7 | 7 | 7 |
| 5 | 1 | 6 | 6 | 6 | 5 | 5 | 5 | 5 | 5 | 5 | 5 |

Max Resistance as % of your Body weight

FIG. 18A

| | | Your Body Weight+weights added Kg | | | | | | | | | | |
|---|---|---|---|---|---|---|---|---|---|---|---|---|
| | Level | 50 | 60 | 70 | 80 | 100 | 120 | 150 | 180 | 240 | 295 | Max Resistance (Kg) |
| PT | 26 | 35 | 41 | 47 | 53 | 64 | 76 | 93 | 111 | 145 | 177 | |
| | 25 | 34 | 40 | 45 | 51 | 62 | 73 | 90 | 107 | 140 | 171 | |
| | 24 | 33 | 39 | 44 | 50 | 60 | 71 | 88 | 104 | 137 | 167 | |
| | 23 | 32 | 37 | 42 | 48 | 58 | 69 | 84 | 100 | 131 | 160 | |
| GTS | 22 | 31 | 36 | 41 | 46 | 56 | 66 | 81 | 96 | 126 | 154 | |
| | 21 | 29 | 34 | 39 | 44 | 53 | 63 | 77 | 92 | 121 | 147 | |
| Sport | 20 | 28 | 32 | 37 | 42 | 51 | 60 | 74 | 88 | 115 | 140 | |
| | 19 | 27 | 31 | 35 | 40 | 48 | 57 | 70 | 83 | 110 | 134 | |
| | 18 | 25 | 29 | 34 | 38 | 46 | 54 | 67 | 79 | 104 | 127 | |
| | 17 | 24 | 28 | 32 | 36 | 44 | 51 | 63 | 75 | 99 | 120 | |
| | 16 | 23 | 26 | 30 | 34 | 41 | 49 | 60 | 71 | 93 | 114 | |
| | 15 | 21 | 25 | 28 | 32 | 39 | 46 | 56 | 67 | 88 | 107 | |
| | 14 | 20 | 23 | 27 | 30 | 36 | 43 | 53 | 63 | 82 | 101 | |
| | 13 | 19 | 22 | 25 | 28 | 34 | 40 | 49 | 59 | 77 | 94 | |
| | 12 | 17 | 20 | 23 | 26 | 32 | 37 | 46 | 54 | 72 | 87 | |
| | 11 | 16 | 19 | 21 | 24 | 29 | 35 | 42 | 50 | 66 | 81 | |
| | 10 | 15 | 17 | 20 | 22 | 27 | 32 | 39 | 46 | 61 | 74 | |
| | 9 | 13 | 16 | 18 | 20 | 24 | 29 | 35 | 42 | 55 | 67 | |
| | 8 | 12 | 14 | 16 | 18 | 22 | 26 | 32 | 38 | 50 | 61 | |
| | 7 | 11 | 13 | 14 | 16 | 20 | 23 | 29 | 34 | 44 | 54 | |
| | 6 | 9 | 11 | 13 | 14 | 17 | 20 | 25 | 30 | 39 | 48 | |
| | 5 | 8 | 10 | 11 | 12 | 15 | 18 | 22 | 26 | 34 | 41 | |
| | 4 | 7 | 8 | 9 | 10 | 13 | 15 | 18 | 22 | 28 | 35 | |
| | 3 | 6 | 6 | 7 | 8 | 10 | 12 | 15 | 17 | 23 | 28 | |
| | 2 | 4 | 5 | 6 | 6 | 8 | 9 | 11 | 13 | 17 | 21 | |
| | 1 | 3 | 3 | 4 | 4 | 5 | 6 | 8 | 9 | 12 | 15 | |

*FIG. 18B*

| Nominal | | Your Body Weight + weights added Kg | | | | | | | | | | |
|---|---|---|---|---|---|---|---|---|---|---|---|---|
| % of BW | Level | 50 | 60 | 70 | 80 | 100 | 120 | 150 | 180 | 240 | 295 | Max Resistance as % of your Body weight |
| | 26 | 77 | 74 | 71 | 70 | 67 | 66 | 64 | 63 | 62 | 61 | |
| 70 | 25 | 74 | 71 | 69 | 67 | 65 | 64 | 62 | 61 | 60 | 59 | |
| | 24 | 72 | 69 | 67 | 66 | 63 | 62 | 61 | 60 | 58 | 58 | |
| 65 | 23 | 69 | 67 | 65 | 63 | 61 | 60 | 58 | 57 | 56 | 55 | |
| | 22 | 67 | 64 | 62 | 60 | 58 | 57 | 56 | 55 | 54 | 53 | |
| 60 | 21 | 64 | 61 | 59 | 59 | 56 | 56 | 56 | 52 | 51 | 51 | |
| | 20 | 61 | 58 | 57 | 55 | 53 | 52 | 51 | 50 | 49 | 48 | |
| 55 | 19 | 58 | 56 | 54 | 53 | 51 | 50 | 48 | 48 | 47 | 46 | |
| | 18 | 55 | 53 | 51 | 50 | 48 | 47 | 46 | 45 | 44 | 44 | |
| 50 | 17 | 52 | 50 | 49 | 47 | 46 | 45 | 44 | 43 | 42 | 42 | |
| 45 | 16 | 49 | 47 | 46 | 45 | 43 | 42 | 41 | 41 | 40 | 39 | |
| | 15 | 46 | 45 | 43 | 42 | 41 | 40 | 39 | 38 | 37 | 37 | |
| 40 | 14 | 44 | 42 | 41 | 40 | 38 | 37 | 36 | 36 | 35 | 35 | |
| | 13 | 41 | 39 | 38 | 37 | 36 | 35 | 34 | 33 | 33 | 32 | |
| 35 | 12 | 38 | 36 | 35 | 34 | 33 | 32 | 32 | 31 | 30 | 30 | |
| | 11 | 35 | 34 | 33 | 32 | 31 | 30 | 29 | 29 | 28 | 28 | |
| 30 | 10 | 32 | 31 | 30 | 29 | 28 | 28 | 27 | 26 | 26 | 26 | |
| | 9 | 29 | 28 | 27 | 27 | 26 | 25 | 24 | 24 | 24 | 23 | |
| 25 | 8 | 26 | 25 | 25 | 24 | 23 | 23 | 22 | 22 | 21 | 21 | |
| | 7 | 24 | 23 | 22 | 21 | 21 | 20 | 20 | 19 | 19 | 19 | |
| 20 | 6 | 21 | 20 | 19 | 19 | 18 | 18 | 17 | 17 | 17 | 16 | |
| | 5 | 18 | 17 | 17 | 16 | 16 | 15 | 15 | 15 | 14 | 14 | |
| 15 | 4 | 15 | 14 | 14 | 14 | 13 | 13 | 13 | 12 | 12 | 12 | |
| 10 | 3 | 12 | 12 | 11 | 11 | 11 | 10 | 10 | 10 | 10 | 10 | |
| | 2 | 9 | 9 | 9 | 8 | 8 | 8 | 8 | 8 | 7 | 7 | |
| 5 | 1 | 6 | 6 | 6 | 6 | 6 | 5 | 5 | 5 | 5 | 5 | |
| | F | 3 | 3 | 3 | 3 | 3 | 3 | 2 | 2 | 2 | 2 | |

FIG. 18C

| | | Your Body Weight+weights added Kg | | | | | | | | | | |
|---|---|---|---|---|---|---|---|---|---|---|---|---|
| | Level | 50 | 60 | 70 | 80 | 100 | 120 | 150 | 180 | 240 | 295 | Max Resistance (Kg) |
| PT | 26 | 38 | 44 | 50 | 56 | 67 | 79 | 96 | 114 | 149 | 181 | |
| | 25 | 37 | 43 | 48 | 54 | 65 | 76 | 93 | 110 | 144 | 174 | |
| | 24 | 36 | 42 | 47 | 53 | 63 | 74 | 91 | 107 | 140 | 170 | |
| | 23 | 35 | 40 | 45 | 50 | 61 | 71 | 87 | 103 | 134 | 163 | |
| GTS | 22 | 33 | 38 | 43 | 48 | 58 | 68 | 84 | 99 | 129 | 156 | |
| | 21 | 32 | 37 | 41 | 46 | 56 | 65 | 80 | 94 | 123 | 150 | |
| Sport | 20 | 30 | 35 | 40 | 44 | 53 | 63 | 76 | 90 | 118 | 143 | |
| | 19 | 29 | 33 | 38 | 42 | 51 | 60 | 73 | 86 | 112 | 136 | |
| | 18 | 28 | 32 | 36 | 40 | 48 | 57 | 69 | 82 | 106 | 129 | |
| | 17 | 26 | 30 | 34 | 38 | 46 | 54 | 65 | 77 | 101 | 123 | |
| | 16 | 25 | 28 | 32 | 36 | 43 | 51 | 62 | 73 | 95 | 116 | |
| | 15 | 23 | 27 | 30 | 34 | 41 | 48 | 58 | 69 | 90 | 109 | |
| | 14 | 22 | 25 | 28 | 32 | 38 | 45 | 55 | 65 | 84 | 102 | |
| | 13 | 20 | 23 | 26 | 30 | 36 | 42 | 51 | 60 | 79 | 96 | |
| | 12 | 19 | 22 | 25 | 27 | 33 | 39 | 47 | 56 | 73 | 89 | |
| | 11 | 17 | 20 | 23 | 25 | 31 | 36 | 44 | 52 | 68 | 82 | |
| | 10 | 16 | 18 | 21 | 23 | 28 | 33 | 40 | 48 | 62 | 75 | |
| | 9 | 15 | 17 | 19 | 21 | 26 | 30 | 37 | 43 | 57 | 69 | |
| | 8 | 13 | 15 | 17 | 19 | 23 | 27 | 33 | 39 | 51 | 62 | |
| | 7 | 12 | 14 | 15 | 17 | 21 | 24 | 29 | 35 | 45 | 55 | |
| | 6 | 10 | 12 | 13 | 15 | 18 | 21 | 26 | 31 | 40 | 49 | |
| | 5 | 9 | 10 | 12 | 13 | 16 | 18 | 22 | 26 | 34 | 42 | |
| | 4 | 7 | 9 | 10 | 11 | 13 | 15 | 19 | 22 | 29 | 35 | |
| | 3 | 6 | 7 | 8 | 9 | 11 | 12 | 15 | 18 | 23 | 28 | |
| | 2 | 5 | 5 | 6 | 7 | 8 | 10 | 12 | 14 | 18 | 22 | |
| | 1 | 3 | 4 | 4 | 5 | 6 | 7 | 8 | 9 | 12 | 15 | |
| | F | 1 | 2 | 2 | 3 | 3 | 3 | 4 | 4 | 2 | 7 | |

*FIG. 18D*

COLLAPSIBLE INCLINABLE EXERCISE DEVICE AND METHOD OF USING SAME

CROSS-REFERENCE TO RELATED APPLICATION

This application claims priority to U.S. provisional patent application 61/377,638 filed on Aug. 27, 2010 under 35 U.S.C. 119. U.S. provisional patent application 61/377,638 is incorporated by reference herein.

FIELD OF THE INVENTION

The present invention relates to an inclinable exercise device.

SUMMARY OF THE INVENTION

An aspect of the invention involves an exercise device including a vertical support member; an adjustable incline having a first end and a second end, the first end of the adjustable incline vertically movable with respect to the vertical support member for setting the incline of the adjustable incline, the adjustable incline including a top rail and a bottom rail pivotally coupled to each other at a first location; a strut with a first end and a second end, the first end of the strut being pivotally coupled to the vertical support member and the second end of the strut being pivotally coupled to the adjustable incline at a second location that is not the same as the first location; a user support platform movably attached to the adjustable incline; first and second pulleys coupled to the adjustable incline; and one or more cables extendable through first and second pulleys and coupled to the user support platform for movement of the support platform along the adjustable incline through cable movement.

One or more implementations of the above aspect of the invention include one or more of the following: a lift-assist mechanism pivotally coupled at one end to the strut and pivotally connected at an opposite end to the top rail; the lift-assist mechanism includes a pair of push-type gas springs; the first location is a first pivot and the second location is a second pivot that is positioned relative to the first pivot so that the lift-assist mechanism provides folding assistance when folding the rails; the exercise device includes a third pivot where the first end of the strut is pivotally coupled to the vertical support member; the exercise device includes a carriage that couples the first end of the adjustable incline with the vertical support member for vertically movement of the carriage and the first end of the adjustable incline relative to the vertical support member, and the exercise device includes a fourth pivot where the first end of the adjustable incline is pivotally coupled to the carriage; the exercise device includes a four-bar linkage between the first pivot, the second pivot, the third pivot, and the fourth pivot; first and second combination pulley-support and pull-up bars pivotally coupled to the first end of the adjustable incline for movement between at least a substantially vertical position and a substantially horizontal position, slots, pull pins engageable in the slots to lock the first and second combination pulley-support and pull-up bars in the substantially vertical position, and cam mechanisms that cause the pull pins automatically engage the slots when the first and second combination pulley-support and pull-up bars are pivoted upward from the substantially horizontal position to the substantially vertical position; a rail lock mechanism that automatically locks the top rail and the bottom rail together in linear alignment at a greater incline and automatically unlocks the top rail and the bottom rail from each other, allowing the top rail and the bottom rail to pivot relative to each other about the second location at a lower incline; the rail lock mechanism includes a latch with a cam member that is operably coupled to the strut to automatically lock the top rail and the bottom rail together in linear alignment at a greater incline and automatically unlock the top rail and the bottom rail from each other, allowing the top rail and the bottom rail to pivot relative to each other about the second location at a lower incline; the adjustable incline includes inside tracks and the user support platform includes rollers that rollably couple the user support platform to the adjustable incline along the inside tracks; the rollers includes a soft rolling member and a flange; the exercise device includes a carriage that couples the first end of the adjustable incline with the vertical support member for vertically movement of the carriage and the first end of the adjustable incline relative to the vertical support member, a carriage lock mechanism that locks the carriage relative to the vertical support member, and a pin that locks the carriage lock mechanism so that a user can lift the vertical support member from a rear of the vertical support member for transporting the exercise device; the exercise device includes a carriage that couples the first end of the adjustable incline with the vertical support member for vertically movement of the carriage and the first end of the adjustable incline relative to the vertical support member, a carriage lock mechanism that locks the carriage relative to the vertical support member, and the vertical support member includes a top with a handle operably coupled to the carriage for unlocking the carriage relative to the vertical support member; first and second combination pulley-support and pull-up bars pivotally coupled to the first end of the adjustable incline, and pulley locator clamps that couple the first and second pulleys to the first and second combination pulley-support and pull-up bars, the pulley locator clamps including multiple curved members pivotally attached together in a closed loop and including a biasing mechanism that urges the curved members towards each other; and/or the first and second combination pulley-support and pull-up bars include multiple bumps spaced thereon and the pulley locator clamps include a hole that receives the bump for positioning and securing the pulley locator clamps on and to the first and second combination pulley-support and pull-up bars.

BRIEF DESCRIPTION OF THE DRAWINGS

FIGS. 18A-18D are exemplary resistance charts/tables for a method of using the exercise device.

DETAILED DESCRIPTION OF PREFERRED EMBODIMENTS

Figure 1A:
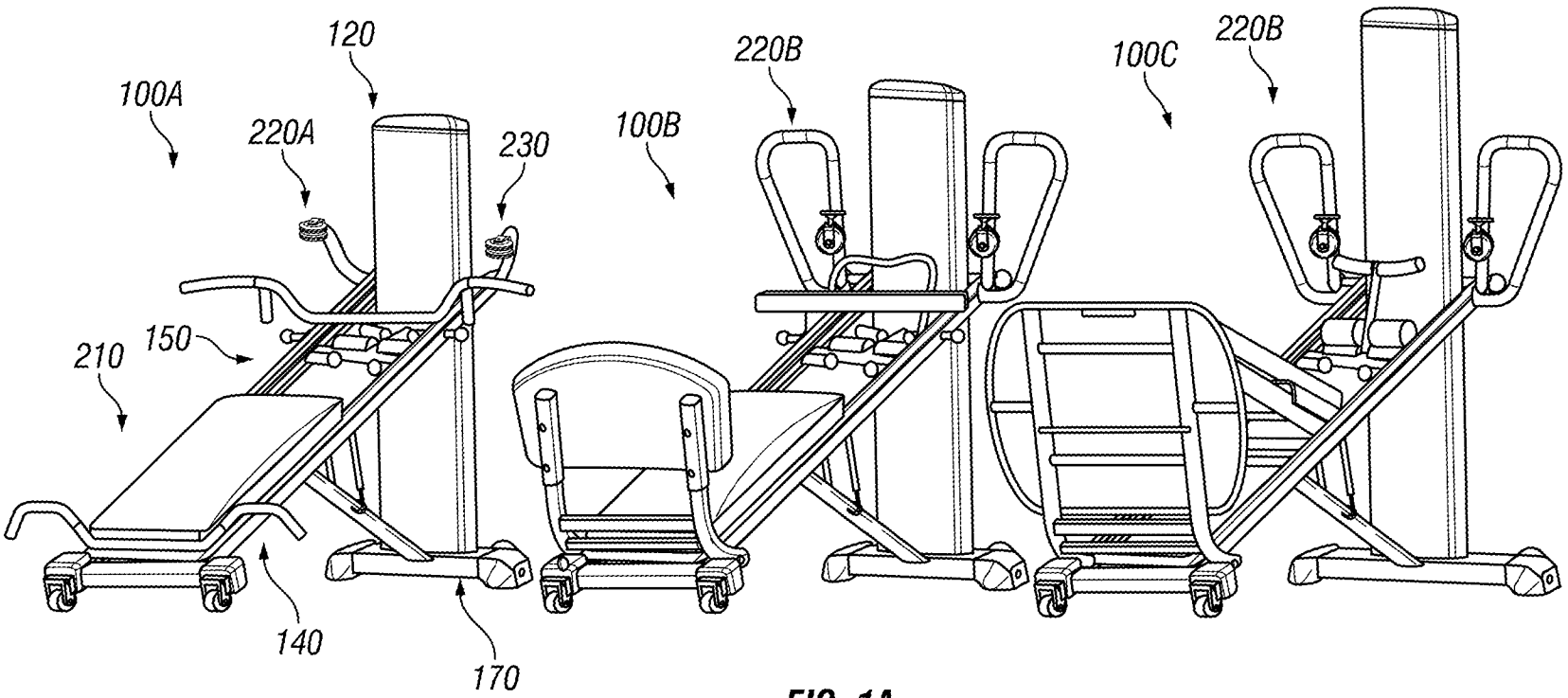
FIG. 1A is a perspective view of a number of embodiments of collapsible inclinable exercise devices.
Figure 1B:
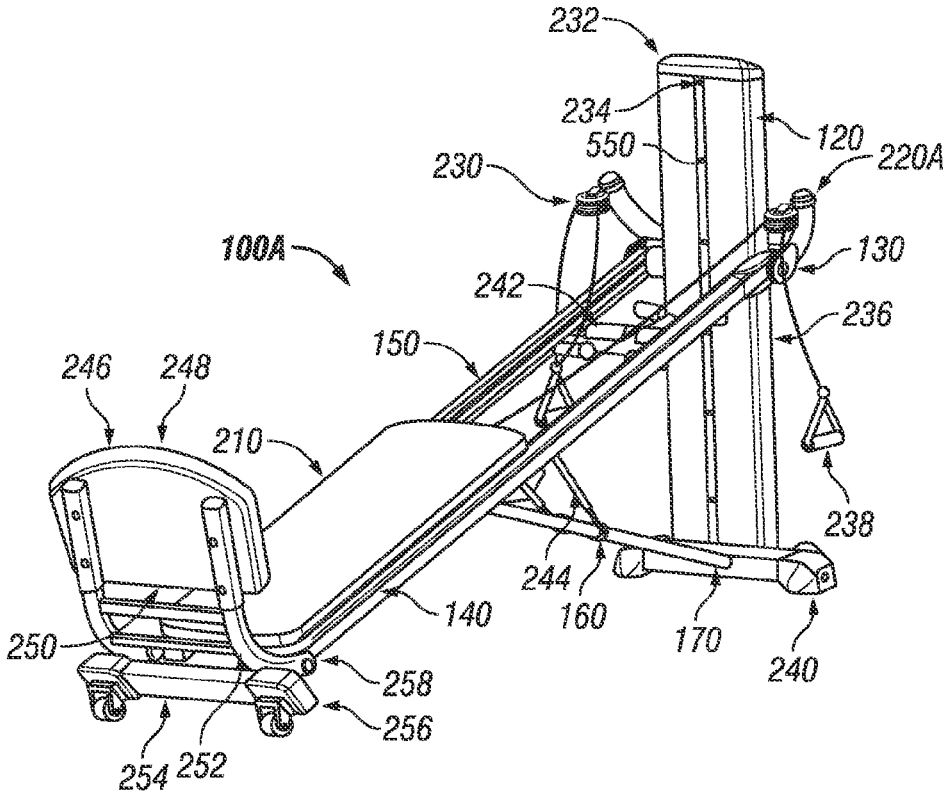
FIGS. 1B and 1C are perspective views of an embodiment of a collapsible inclinable exercise device shown in FIG. 1A.
Figure 1C:
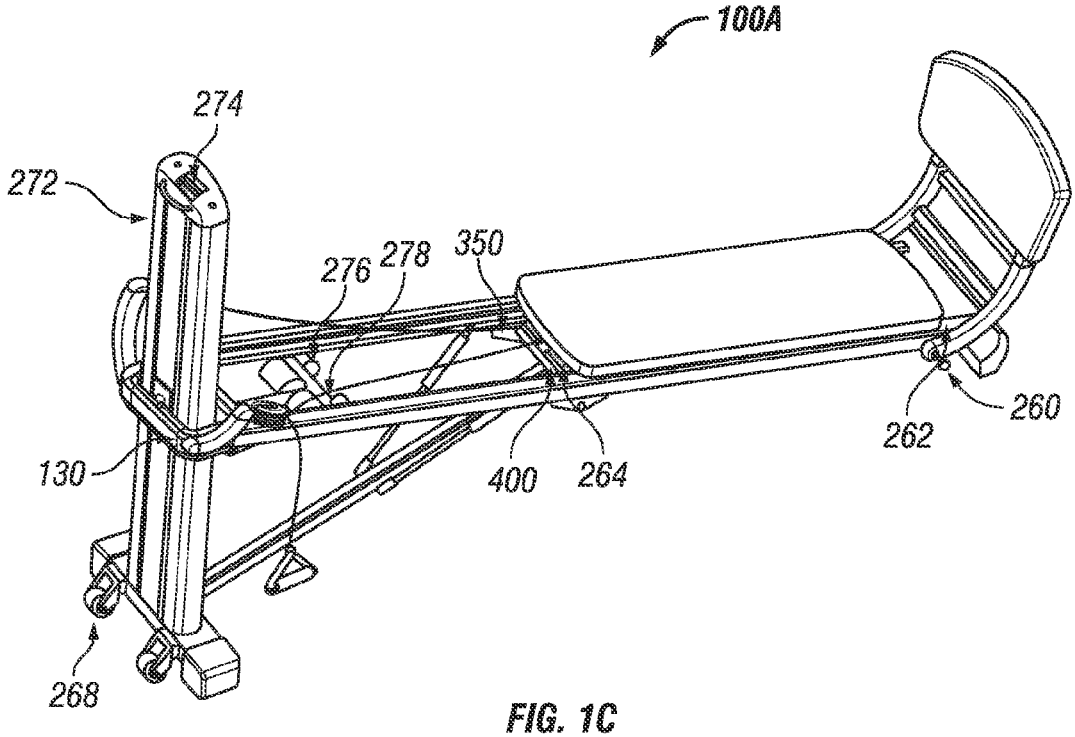
Figure 1D:
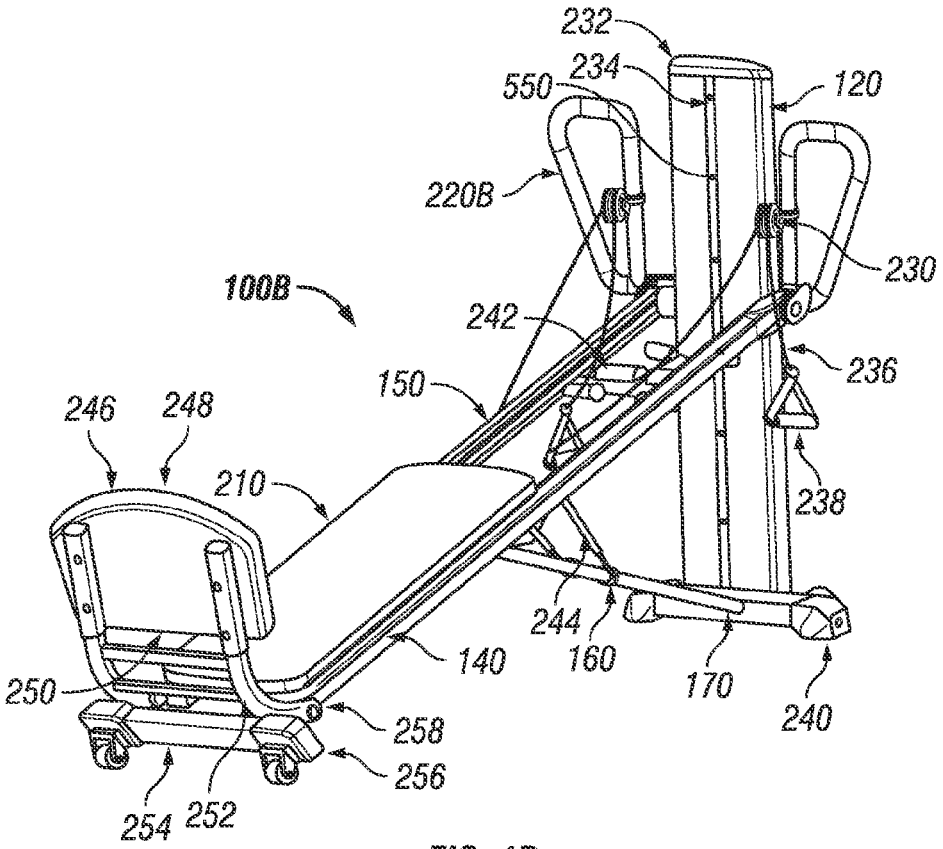
FIGS. 1D and 1E are perspective views of another embodiment of a collapsible inclinable exercise device shown in FIG. 1A.
Figure 1E:
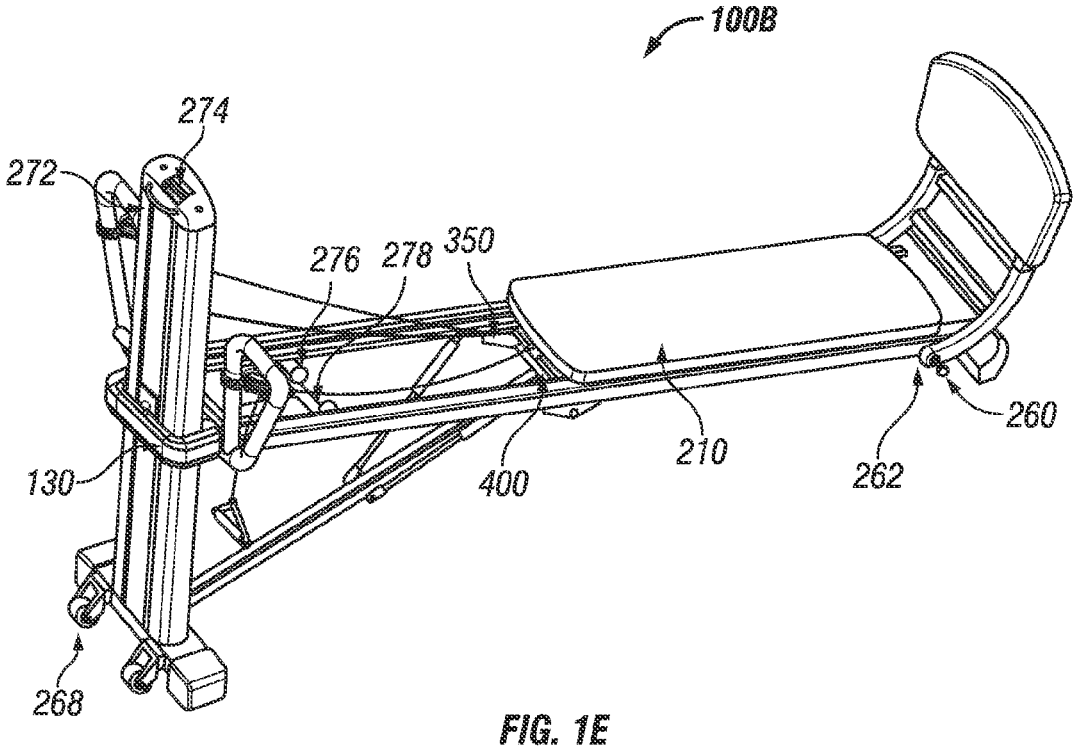

FIGS. 1A-6 illustrate a number of embodiments of collapsible inclinable exercise devices 100A, 100B, 100C, 100D including a collapsing mechanism 110. Before describing the collapsing mechanism 110 in detail, the collapsible inclinable exercise devices 100A, 100B, 100C, 100D will first be generally described.

The inclinable exercise devices 100A, 100B, 100C, 100D include tower 120 with a carriage 130 vertically slidable along the tower 120.

As shown in FIGS. 2-6, bottom rails 140 are pivotally coupled to top rails 150 at pivot(s)/hinge(s) A. Top rails 150 are pivotally connected to carriage 130 at pivot(s)/hinge(s) B. A plyo strut 160 is pivotally connected at one end to a base 170 at pivot(s)/hinge(s) C and is pivotally connected at an opposite end to bottom rail 140 at pivot(s)/hinge(s) D.

A lift-assist mechanism 180 is pivotally connected at one end to the plyo strut 160 at pivot(s)/hinge(s) 190 and is pivotally connected at an opposite end to the top rails 150 at pivot(s)/hinge(s) 200. In the embodiment shown, the lift-assist mechanism 180 includes two push-type gas spring/struts between the plyo strut 160 and the upper rail 150. The gas struts attach at angles to prevent pinch point(s) and to balance the load symmetrically. The combined force of the gas struts performs two separate functions: 1) level change lift assist, and/or 2) fold lift assist. The push-type gas spring provides an upward angled force towards the pivot(s)/hinge (s) 200, reducing the upward force and work required by a user when raising the height and increasing the angle of the top rails 150 relative to the ground and when folding/collapsing (See FIG. 3) the inclinable exercise device 100A, 100B, 100C, 100D. This upward force imparted by the lift-assist mechanism 180 also makes it easier to lower the height and reduce the angle of the top rails 150 because it reduces the lifting work required of the user.

As shown in FIGS. 1A-1G, a user support platform or glideboard 210 with rollers (not shown) rolls along the rails 140, 150.

The carriage 130 is coupled to arms 220A, pulley arms 220B. Attached to the arms 220A, pulley arms 220B are pulleys 230.

Although not shown, a connector extends through the pulleys 230 and connects to the user support platform 210. The connector may be of any suitable well-known type, but is preferably a cable with handles at each end. The cable extends through the pulleys 230 positioned on the pulley arms 220A, 220B and loops through a third pulley attached to the user support platform 210. The third pulley is positioned along the lateral centerline of the user support platform. This position allows for unilateral (i.e. one arm), bilateral (i.e., two arm) and static equilibrium (i.e. holding the user support platform 210 suspended by keeping a constant force on each handle) use. The cable should preferably be of sufficient length to extend through the pulleys 230 and allow the exerciser to grasp one or both of the handles while the exerciser is on the user support platform 210 and the user support platform 210 is at rest.

In an alternate embodiment, the connector is two separate cables extending through the pulleys 230 with each cable fixedly attached to the user support platform 210.

As shown in FIGS. 1B-1G, the collapsible inclinable exercise devices 100A, 100B, 100C, 100D include tower cap 232, fold bar 234, pulley attach bars 550, incline scale 236, cable handles 238, tower foot 240, foot holder 242, gas struts 244, squat stand 246, squat handle 248, squat adjust lever 250, squat forks 252, rail base 254, rail foot 256, removal pull pin 258, squat fold pull pin 260, index pin plate 262, glideboard "D" ring 264, rail fold latch/arm/lever 400, rail lock 350, transport wheels 268, tower lift-lock lever, center pulley storage ring 272, rail incline release lever 274, foot holder removal pull pin 276, foot holder lowering lever 278, incline up/down switch 280, LED 282, remote control cable handlebars 284, glideboard frame 286, tilt adjust lever 288, and safety key 290.

With reference to FIGS. 2-6, the collapsing mechanism 110 will be described in more detail. The collapsing mechanism 110 includes the pivot(s)/hinge(s) A, B, C, D located at strategic locations on the inclinable exercise device 100A, 100B, 100C, 100D so as to facilitate collapsing and deployment of the inclinable exercise device 100A, 100B, 100C, 100D while preventing the tower 120 from accidentally toppling over during collapsing, deployment, and/or use. In FIGS. 2-6, lines identified as Link 1 L1 (or top rail 150/Link 1 L1), Link 2 L2 (or bottom rail 140/Link 2 L2), Link 3 L3 (or plyo strut 160/Link 3 L3), and Link 4 L4 (or tower 120/Link 4 L4) are shown between pivot(s)/hinge(s) A, B, C, D. These lines are shown to assist the reader in understanding the invention and do not represent any structural elements. The inclinable exercise device 100A, 100B, 100C, 100D is indicated herein as having a four-bar linkage between top rail 150/Link 1 L1, bottom rail 140/Link 2 L2, plyo strut 160/Link 3 L3, and tower 120/Link 4 L4. It should be noted that the lift-assist mechanism 180 is not shown in FIGS. 4-6 in order to assist the reader in understanding the invention.

Pivot(s)/hinge(s) A allows the top rails 150 and the bottom rails 140 to pivot relative to each other, which is important when collapsing/folding the rails 140, 150 together for storage of the inclinable exercise device 100A, 100B, 100C, 100D.

Pivot(s)/hinge(s) B allows the top rails 150 to pivot relative to the carriage 130, which is important when adjusting the height of the carriage 130/incline of the rails 140, 150.

Figure 4:
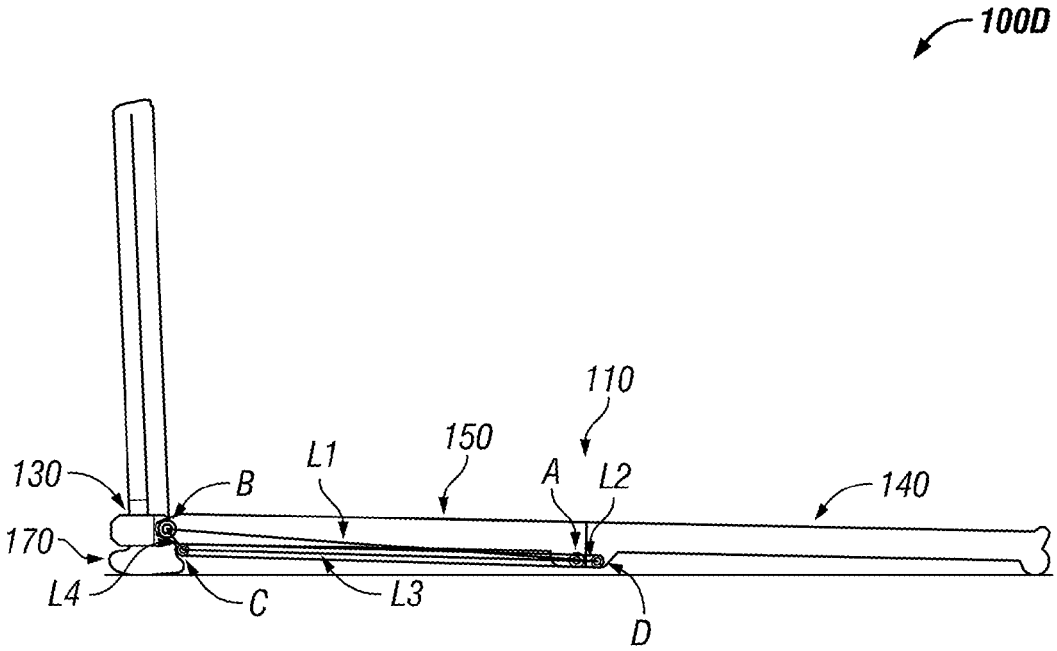
FIG. 4 is a front elevational view of the collapsible inclinable exercise device of FIG. 2 shown in a deployed condition with the incline of the collapsible inclinable exercise device shown substantially level (i.e., at a 1.5 degree incline) and without the gas strut.

Pivot(s)/hinge(s) C is positioned relative to the base and relative to carriage 130 and rails 140, 150 so that the tower 120 is always structurally supported (e.g., to prevent the tower 120 from accidentally falling over during collapsing and deployment of the inclinable exercise device 100A, 100B, 100C, 100D). For example, as shown in FIG. 4, even when the carriage 130 is at its lowest position relative to the tower 120, pivot(s)/hinge(s) B are above pivot(s)/hinge(s) C, which are at the base 170. Because the lateral movement of the tower 120 is restricted at two vertically spaced points, one at the base 170, one vertically spaced above the base 170, the tower 120 may lean slightly away from vertical, but is prevented from toppling over.

Pivot(s)/hinge(s) D is positioned relative to the pivot(s)/hinge(s) A so that the lift-assist mechanism 180 can provide folding assistance when folding/collapsing the rails 140, 150 and the inclinable exercise device 100A, 1008, 100C, 100D. The top rail 150 and the bottom rail 140 are pivotally coupled to each other at and define a first rotational axis at Pivot(s)/hinge(s) A. A second end of the plyo strut 160 is pivotally coupled to the bottom rail 140 of the adjustable incline at and defining a second rotational axis at Pivot(s)/hinge(s) D, which is a second location that is not the same as the first location so that the first and second rotational axes are not collinear.

Figure 2:
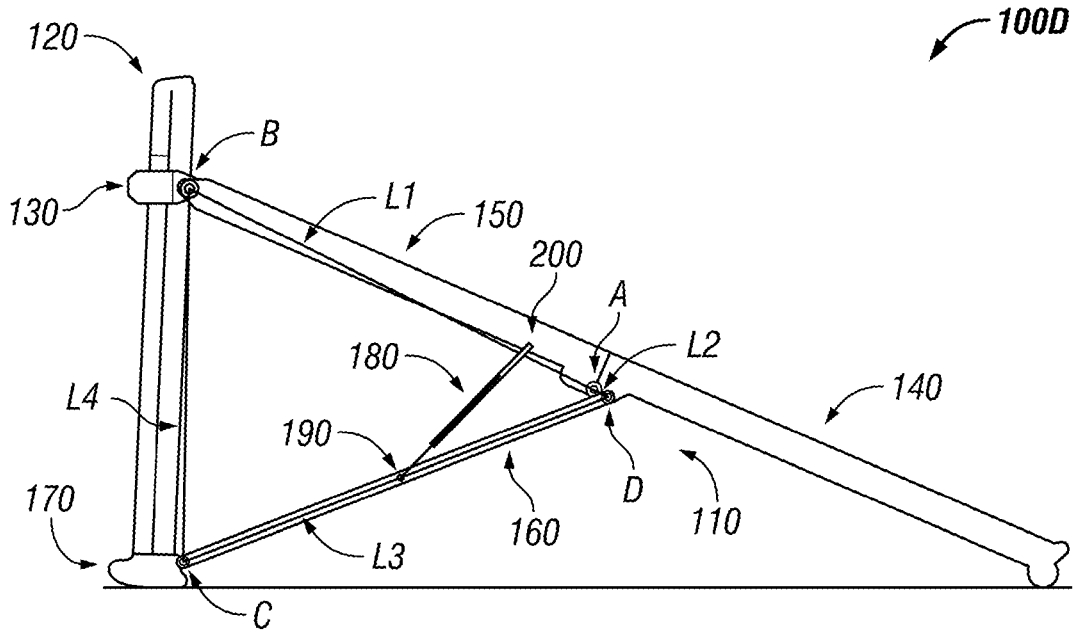
FIG. 2 is a front elevational view of an embodiment of a collapsible inclinable exercise device with the collapsible inclinable exercise device shown in a deployed condition with the incline of the collapsible inclinable exercise device at an angle and with a gas strut.
Figure 3:
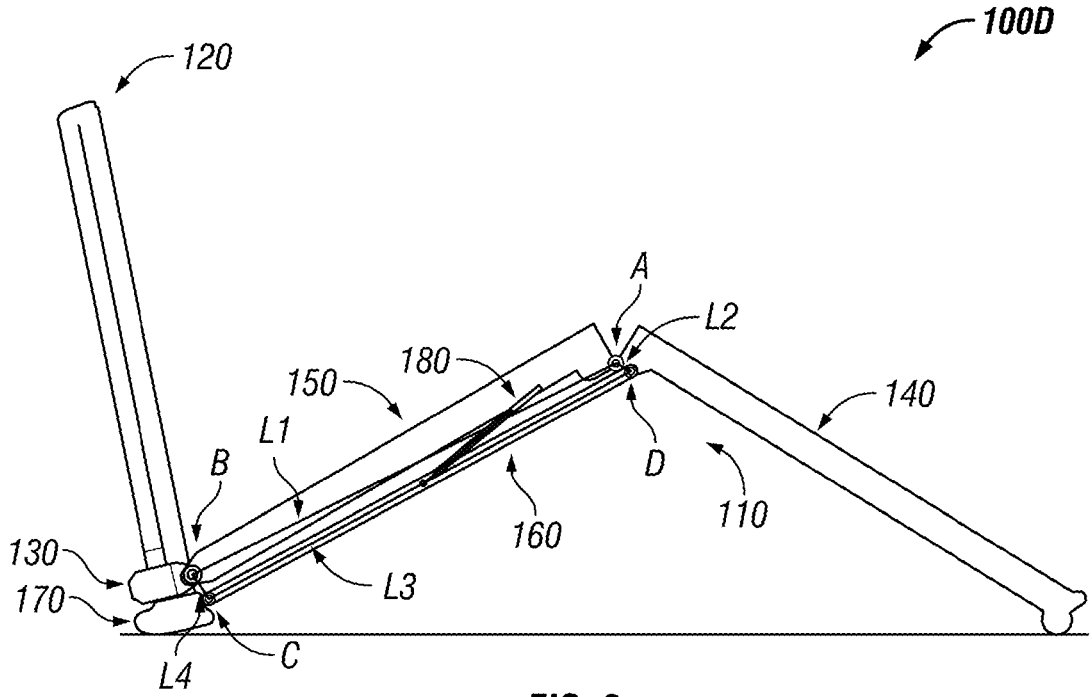
FIG. 3 is a front elevational view of the collapsible inclinable exercise device of FIG. 2 shown in a partially collapsed condition.

With reference to FIGS. 2 and 3, lift assistance and fold assistance provided by the lift-assist mechanism 180 will be described in more detail.

With reference to FIG. 2, the lift-assist mechanism 180 (e.g., gas strut) is attached between the plyo strut 160 and the top rail 150. When raising the carriage 130 and the angle of the rails 140, 150 to adjust the incline of the rails 140, 150, the carriage 130 slides along the tower 120. The top rails 150 and the bottom rails 140 act together as a single link. The tower 120 anchors the lower pivot point C of the plyo strut 160. The force of the strut 180 acts strongly to rotate Link 2 L2/bottom rail and Link 1 L1/top rail about pivot(s)/hinge(s) D to provide lift assistance, reducing the upward force and work required by a user when raising the height and increasing the angle of the top rails 150 relative to the ground.

With reference to FIG. 3, the lift-assist mechanism 180 (e.g., gas strut) is attached between the plyo strut 160 and the top rail 150. When folding the inclinable exercise device 100A, 100B, 100C, 100D, with the carriage 130 lowered to its lowest vertical position shown in FIG. 3, the tower 120 and the carriage 130 remain relatively stationary, anchoring the lower end of the plyo strut 160. The force of the lift-assist mechanism 180 acts roughly along the top rail 150/Link 1 L1. This causes the lower rail 140/Link 2 L2 to rotate around pivot(s)/hinge(s) D, the top pivot of the plyo strut 160/Link 3 L3. This mode of force is referred to herein as fold, folding, or collapsing assistance.

Figure 5:
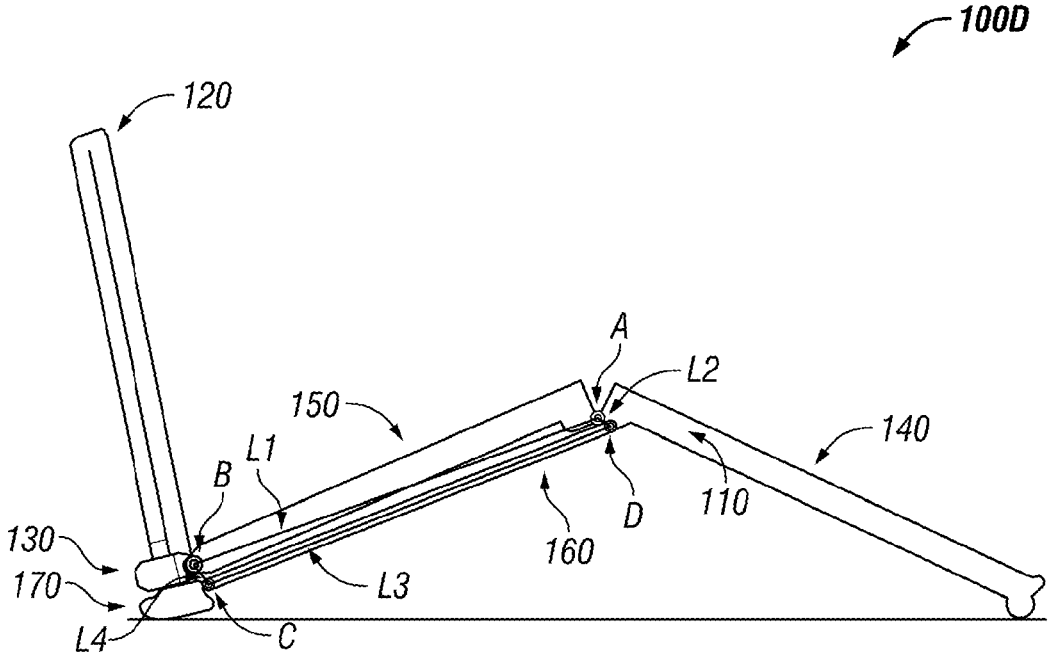
FIG. 5 is a front elevational view of the collapsible inclinable exercise device of FIG. 2 shown in a partially collapsed condition and without the gas strut.
Figure 6:
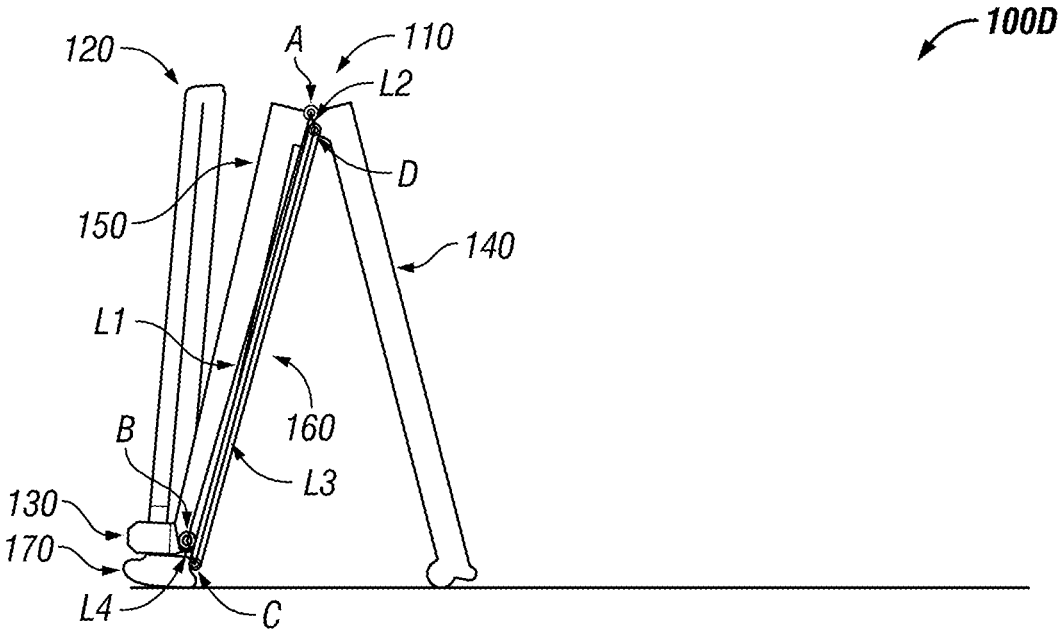
FIG. 6 is a front elevational view of the collapsible inclinable exercise device of FIG. 2 shown in a substantially collapsed condition and without the gas strut.

With reference to FIGS. 4-6, the stability features of the collapsing mechanism 110 to prevent the tower 120 from accidentally toppling over during collapsing, deployment, and/or use will now be described in more detail.

With reference to FIG. 4, when the rails 140, 150 are at the lowest angle possible, the top rail 150/Link 1 L1 and the bottom rail 140/Link 2 L2 are in toggle (i.e., they are in line and can exert maximum force from one to another). The tower 120 is a sliding link (Link 4 L4), which is mostly vertical. Since there is vertical separation between pivot(s)/hinge(s) B and C, even when the rails 140, 150 are at the lowest angle possible, the tower 120 is supported so it will not fall down.

With reference to FIG. 5, the inclinable exercise device 100A, 100B, 100C, 100D can only fold by lifting the rails 140, 150. It is important to note the angle change in bottom rails 140/Link 2 L2 during folding (i.e., progressing from configuration shown in FIG. 4 to configuration shown in FIG. 6). The bottom rail 140/Link 2 L2 is nearly horizontal when folding was started and tower 120/Link 4 L4 was nearly vertical (See FIG. 4). Because top rail 150/Link 1 L1 and plyo strut 160/Link 3 L3 are long relative to bottom rail 140/Link 2 and tower 120/Link 4 L4, they remain relatively parallel to each other through out 90 degree rotation during folding. The bottom rail 140/Link 2 L2 undergoes a rotational angle change of 90 degrees relative to stationary tower 120/Link 4 L4. In all stages of folding the inclinable exercise device 100A, 100B, 100C, 100D, the tower 120 is supported and stable so it will not fall.

With reference to FIG. 6, continued lifting of the rails 140, 150 in the manner shown causes the inclinable exercise device 100A, 100B, 100C, 100D to fold. It is important to note the angle change of bottom rail 140/Link 2 L2, which goes into toggle in the opposite direction to that mentioned above when folded all the way at the top. In all stages of folding the inclinable exercise device 100A, 100B, 100C, 100D, the tower 120 is supported and stable so it will not fall.

Thus, the four-bar linkage between top rail 150/Link 1 L1, bottom rail 140/Link 2 L2, plyo strut 160/Link 3, and tower 120/Link 4 L4 of the inclinable exercise device 100A, 100B, 100C, 100D simplifies folding and unfolding to constrain and control all parts throughout the kinematic motion of folding and unfolding. This eliminates the need of restraining pins during the process. Reducing the number of steps to fold and unfold reduces the probability of a user to make a mistake and become injured or cause property damage. The four-bar linkage maintains stable support for the tower 120 throughout all levels of incline and all angles during folding. The linkage lengths are optimized so that the tower 120 leans the minimum forward when inclined and the minimum backward when folding and the plyo strut 160 does not need to be telescoped. The four bar linkage also allows the range of inclines to be lowered safely without adding locking pins to prevent the tower 120 from accidentally falling.

Additional Features

Figure 7A:
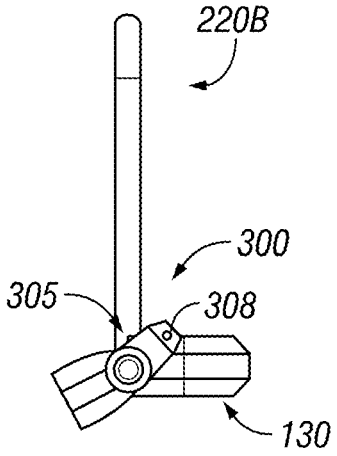
FIGS. 7A-7F are side elevational and front elevational views of an embodiment of a lat bar cam mechanism and shows the lat bar in a variety of different positions.
Figure 7B:
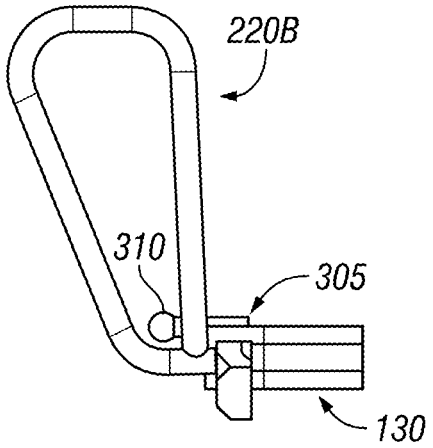
Figure 7C:
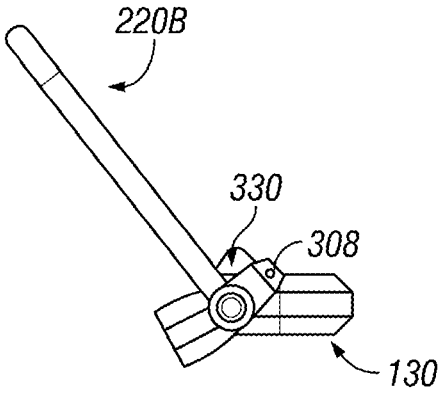
Figure 7D:
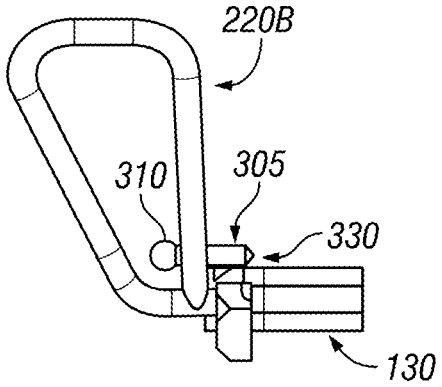
Figure 7E:
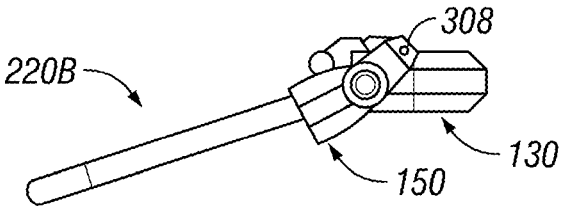
Figure 7F:
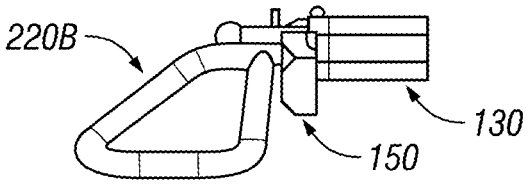
Figure 8:
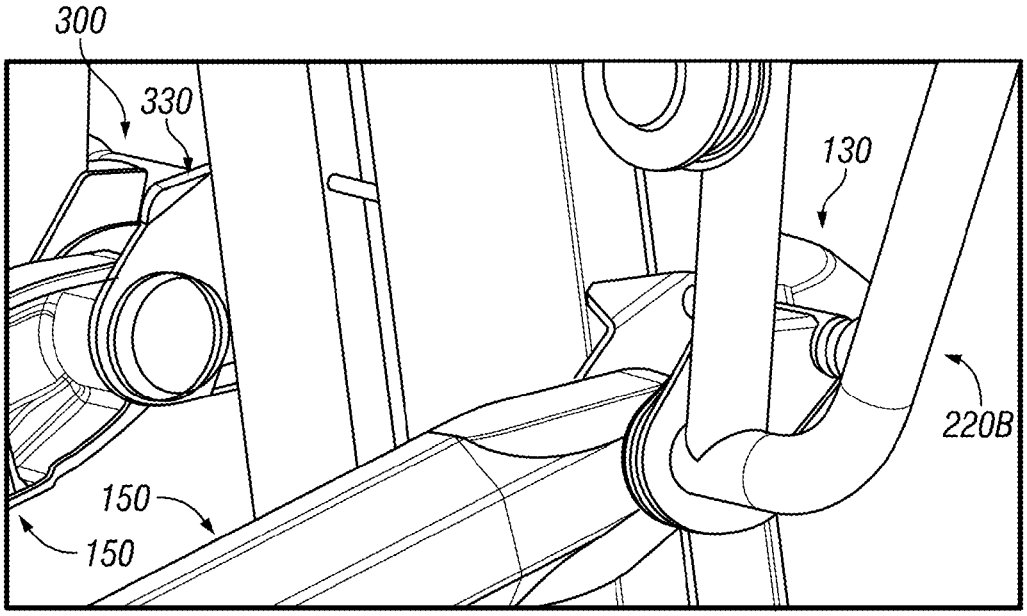
FIGS. 8-11C are perspective views of portions of the collapsible inclinable exercise device and shows the lat bar cam mechanism illustrated in FIGS. 7A-7G.
Figure 9:
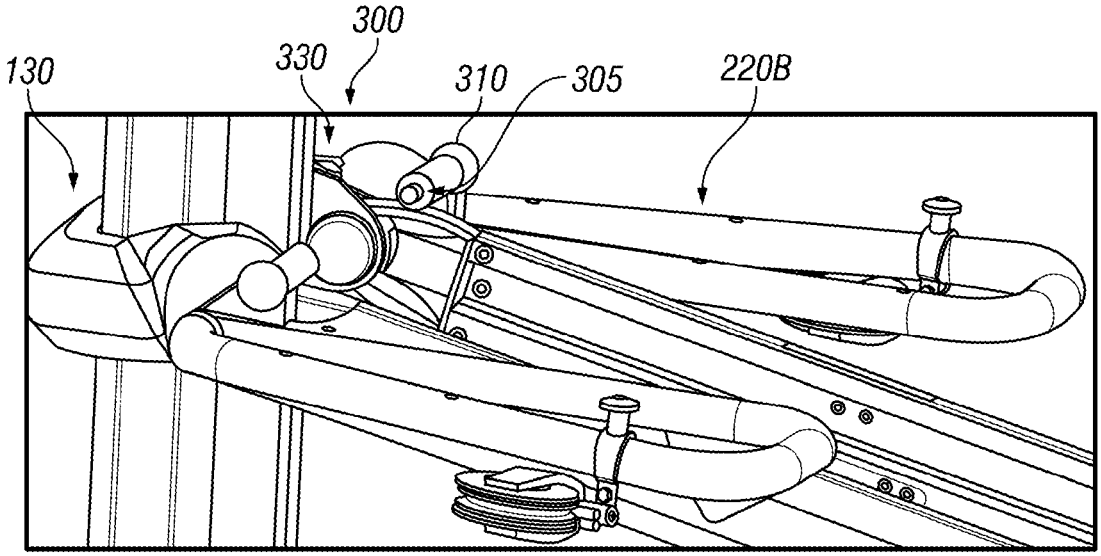
Figure 10:
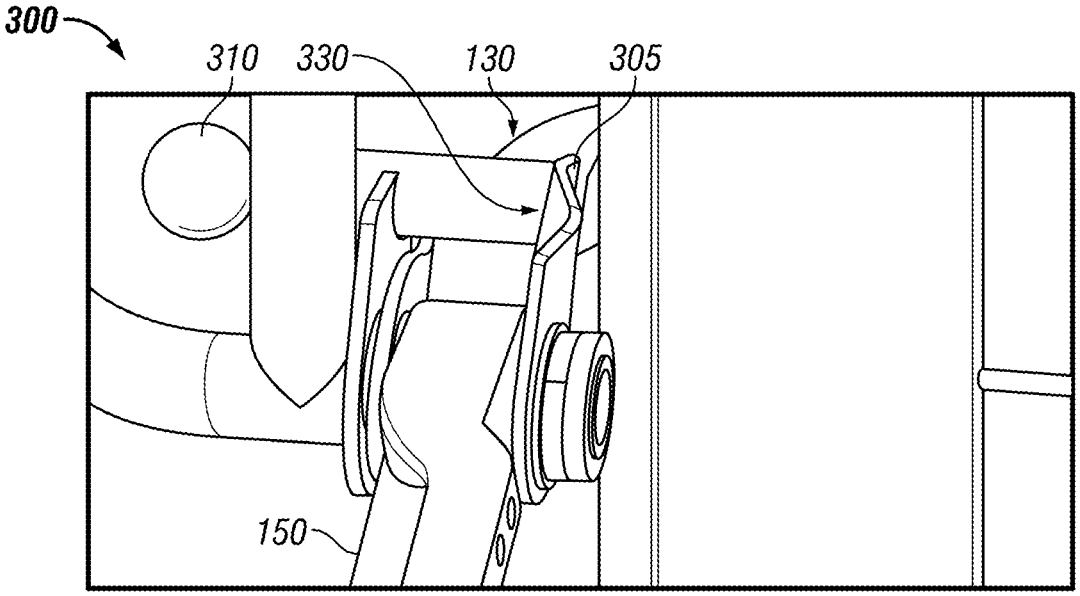
Figure 11A:
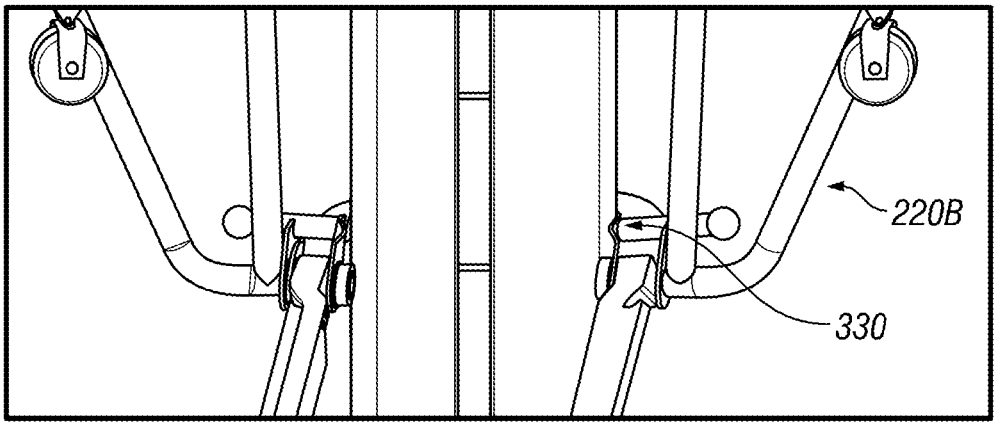
Figure 11B:
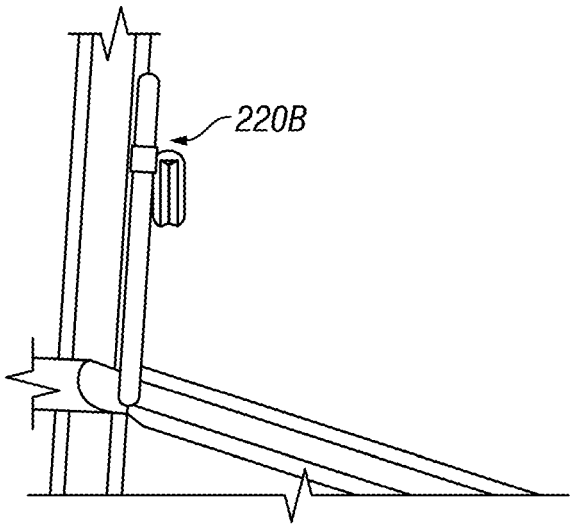
Figure 11C:
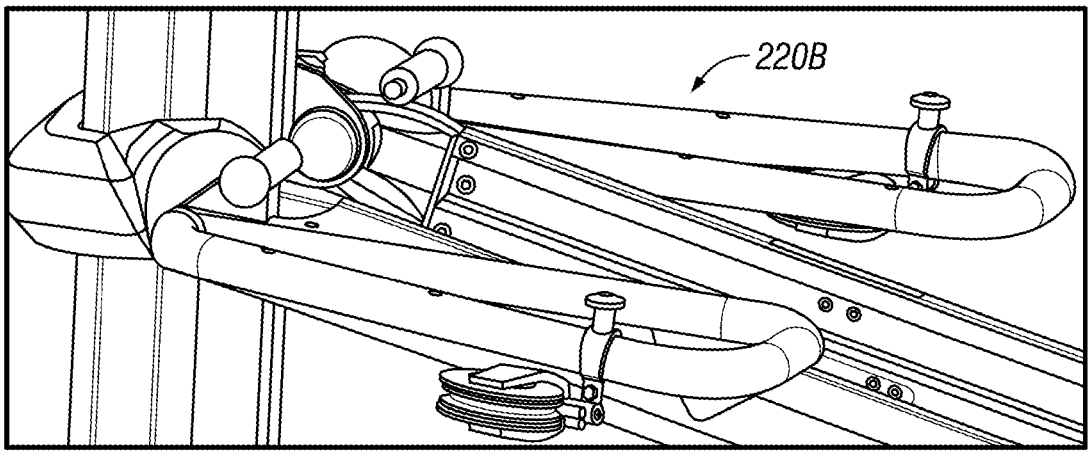
Figure 12:
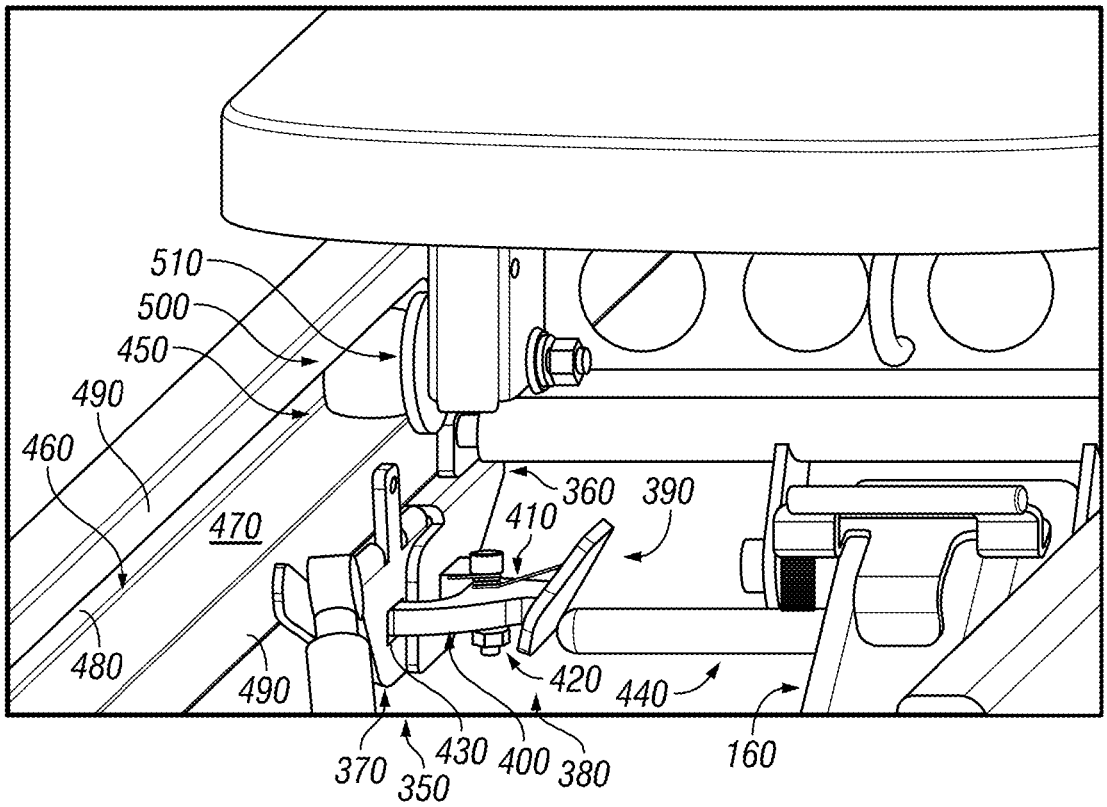
FIG. 12 is a perspective view of an embodiment of a rail lock cam mechanism.
Figure 13:
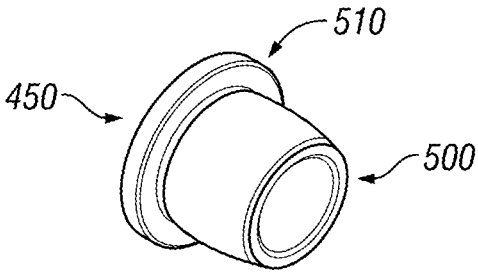
FIG. 13 is a perspective view of an embodiment of a roller.
Figure 14:
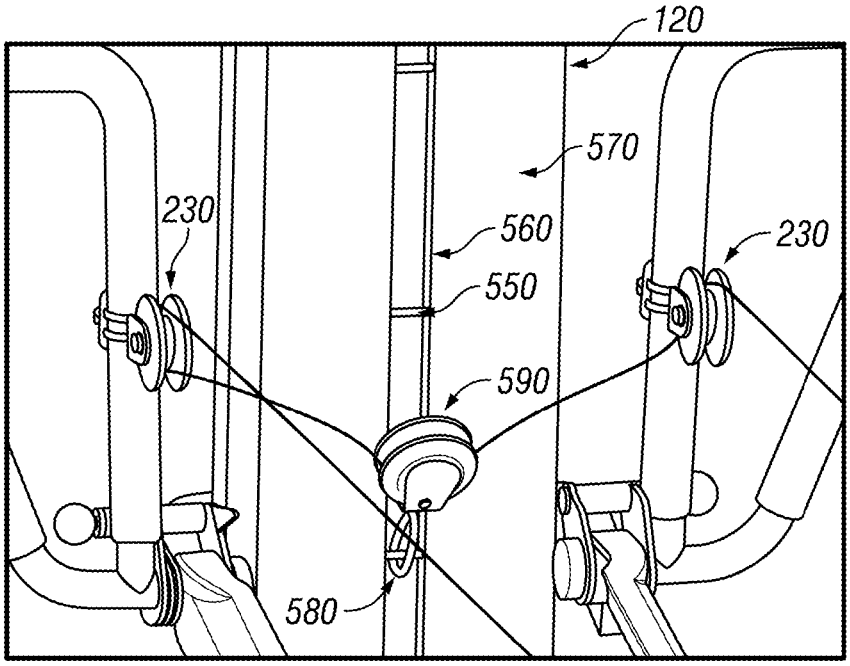
FIG. 14 is a perspective view of an embodiment of tower attachment rungs.
Figure 15A:
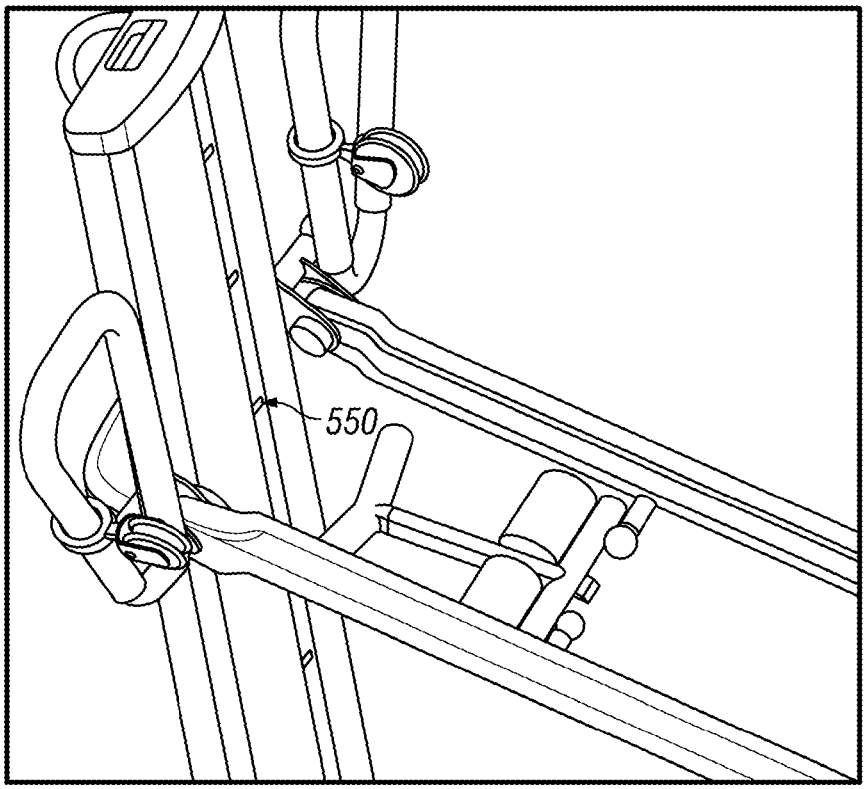
FIG. 15A-15C are perspective views of an embodiment of a handle operably connected to an internal portion of the tower for locking/unlocking a carriage of the collapsible inclinable exercise device relative to the tower.
Figure 15B:
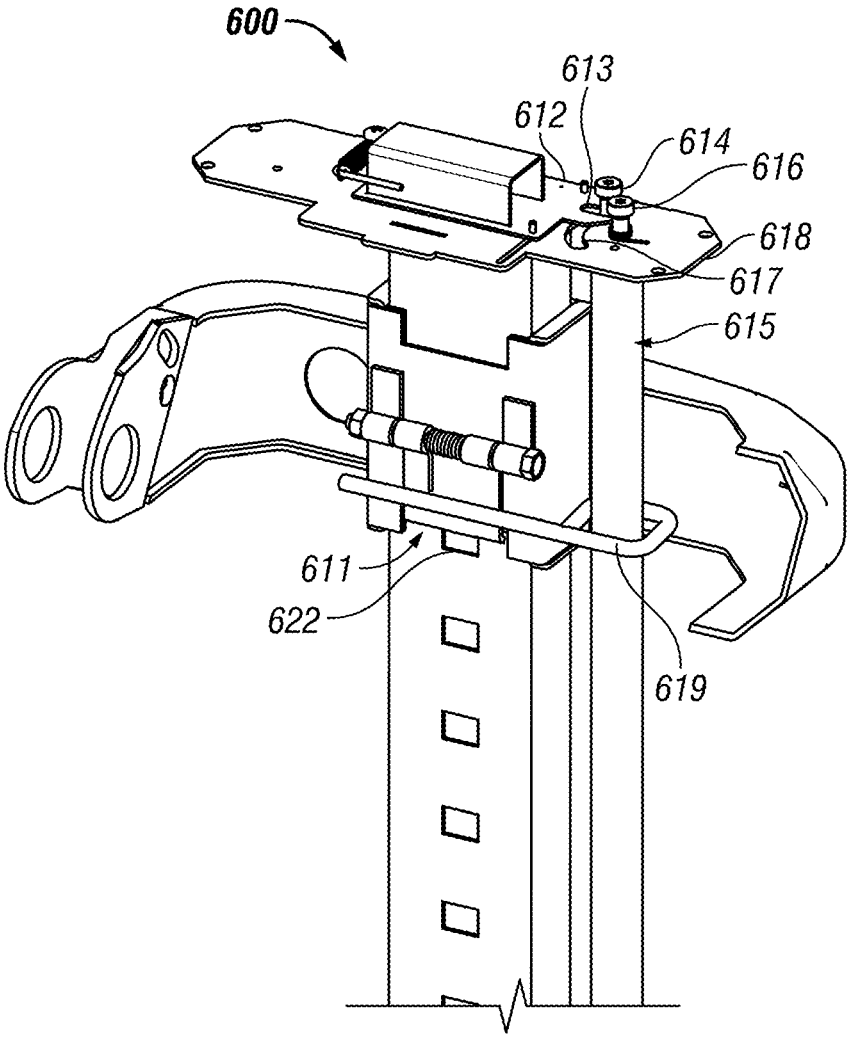
Figure 15C:
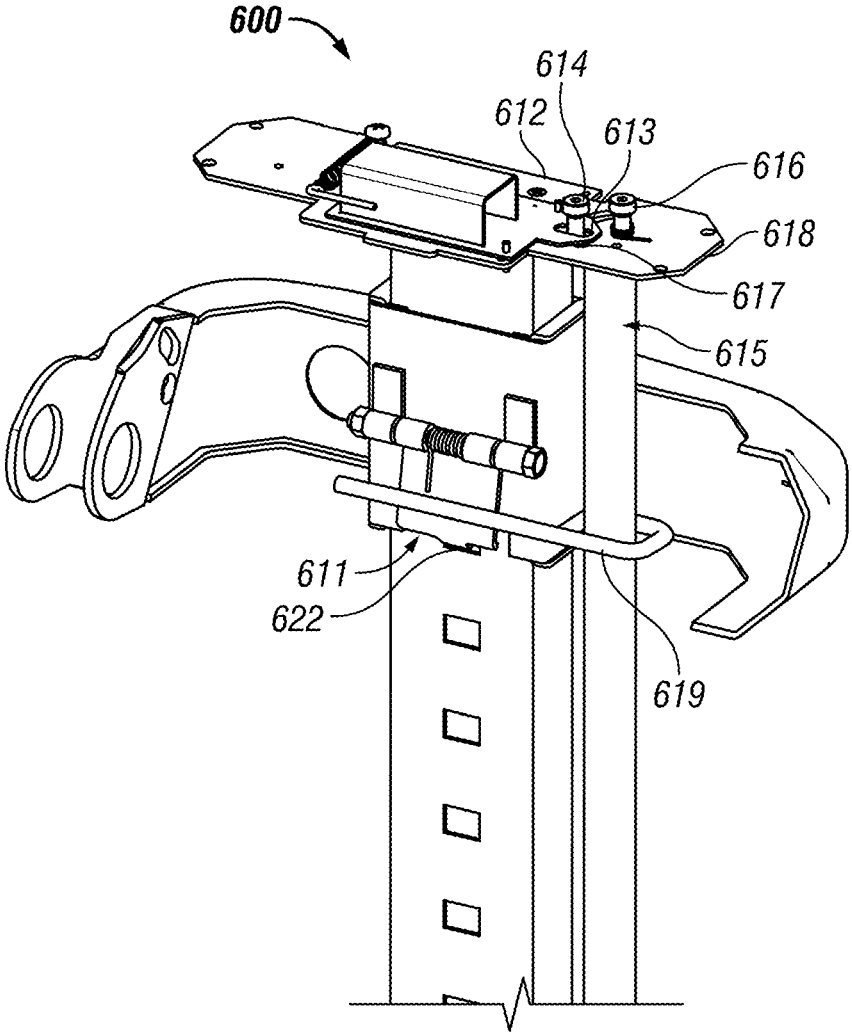
Figure 16A:
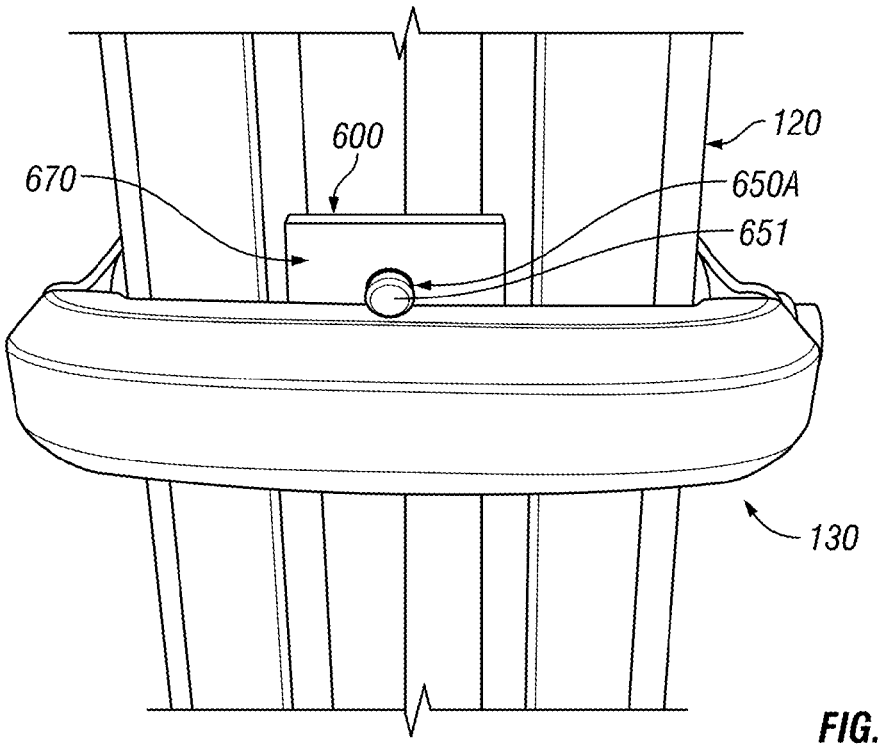
FIGS. 16A and 16B are perspective views of embodiments of carriage lock levers.
Figure 16B:
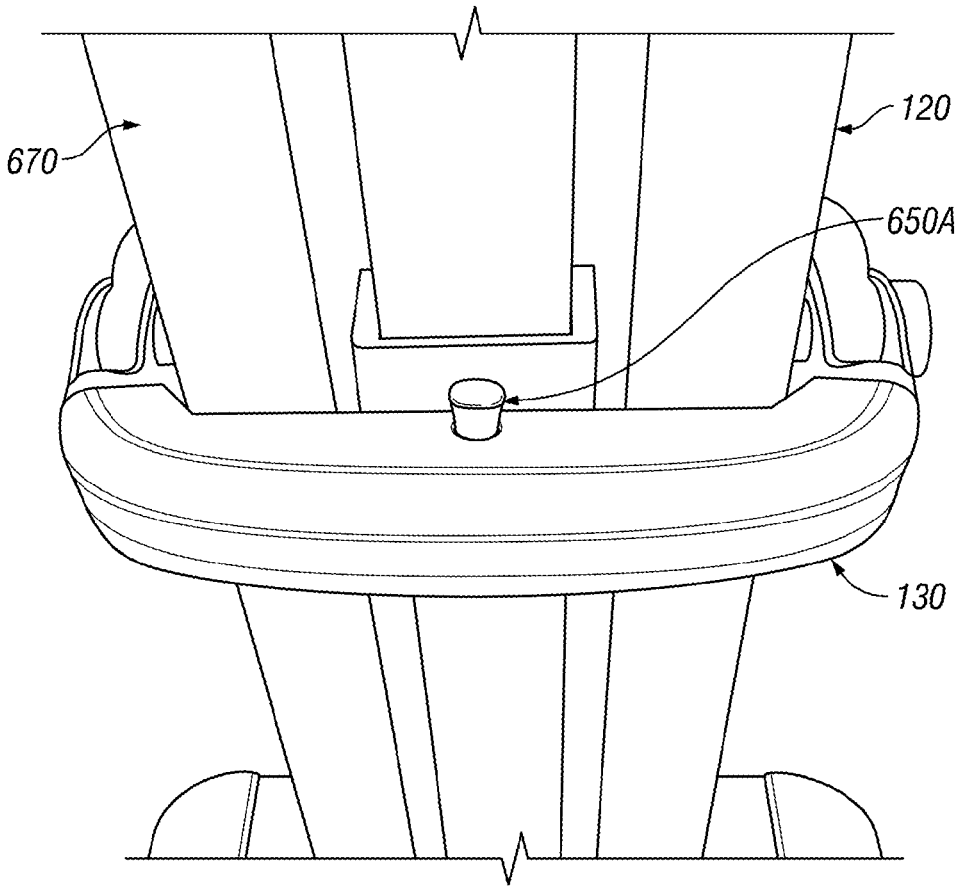

With reference to FIGS. 7A-17C, one or more implementations of the inclinable exercise device 100A, 100B, 100C, 100D include one or more of the following:

1) As shown in FIGS. 7A-11C, the inclinable exercise device 100A, 100B, 100C, 100D includes a lat bar cam mechanism 300 attached to the carriage 130 that causes pull pins 305 to automatically engage slots 308 when the lat bar 220B is raised manually or automatically when the inclinable exercise device 100A, 100B, 100C, 100D is folded. The pull knobs 310 at the end of the pull pins 305 are pulled outwardly to disengage the pull pins 305 from the slots 308 to unlock the lat bar 220B. The lat bar 220Bs are lowered to the position shown in FIG. 9 for doing pull ups. FIGS. 7A, 7B show that the pull pin 305 restrains LAT bar rotation forward by slot 308 with LAT bar 220B in the upright position. FIGS. 7C, 7D show that flange 330 on carriage 130 acts as a cam to push LAT bar pull pin 305 in as LAT bar 220B rotates from pull-up position to upright/fold position. During this transition rotation, the flange/cam 330 just begins to press in the pull pin 305. FIGS. 7E, 7F show LAT bar pull pin cylinder restrains rotation to contact the rail 150 with the LAT bar 220B in the pull-up position;
2) With reference to FIG. 12, there is an automatic rail lock mechanism 350 that will engage at high inclines (e.g., for plyometrics) and will disengage at low inclines for folding the inclinable exercise device 100A, 1008, 100C, 100D. The rail lock mechanism 350 includes a top rail flange/hinge 360, a bottom rail flange/hinge 370, a rail lock cam mechanism 380, a cam member 390, an arm/lever 400, a spring 410, a pivot 420, a slot 430, and an engagement arm/rod 440. The spring 410 urges the arm/lever 400 to engage the slot 430 to lock the rails 140, 150 together via the top rail flange/hinge 360 and the bottom rail flange/hinge 370. This prevents the rails 140, 150 from folding during plyometric use. The rail lock mechanism 350 automatically releases when the rails 140, 150 are at the lowest level where the inclinable exercise device 100A, 1008, 100C, 100D can be folded. At this lowest level, the engagement rod 440 on the plyo strut 160 contacts the cam member 390, causing the arm/lever to rotate out of the slot 430, allowing the rails 140, 150 to pivot/fold relative to each other. When the rails 140, 150 are linearly aligned and simultaneously raised from the lowest level, the engagement rod 440 moves away from the cam member 390, allowing the spring 410 to urge the arm/lever 400 to engage the slot 430 to lock the rails 140, 150 together via the top rail flange/hinge 360 and the bottom rail flange/hinge 370;

3) With reference to FIGS. 12 and 13, rollers 450 of the support platform/glideboard 210 roll on inside/inside track 460 of the rails 140, 150 to allow tilting support and steeper incline support all the way to vertical. The rollers 450 inside the rails 140, 150 also add more stability, which is necessary for the tilting user support platform/glideboard 210. Each inside track 460 includes lower/upper engagement faces 470, inner wall 480, and lower/upper faces 490. The rollers include two materials: a soft rolling member/tire 500 for quiet smooth rolling on aluminum lower/upper engagement faces 470, and a flange 510 made of a hard slippery nylon to keep the user support platform/glideboard 210 on track without creating excess drag when twisting loads are applied;

4) With reference to FIG. 14, the tower 120 includes a ladder of rungs/bars 550 in a center channel 560 on a front 570 of the tower 120 to hook (via a connector/clip 580) a center pulley 590 or a leg pulley (for a leg pulley accessory) at various positions. Attaching the pulley 590 reduces the mechanical advantage and reduces cable length, providing more resistance loading for more exercises. The center pulley 590 is connected to a rung 550 at a height/level at or below the height/level of the pulleys 230 The leg pulley accessory also benefits from having a variety of attach points to improve the line of resistance;

5) With reference to FIGS. 15A-15C, a handle 600 at a top of the tower 120 functions like a car door handle at the top of inclinable exercise device 100A, 1008, 100C, 100D. The user first lifts the rails 140, 150 slightly to unload the handle 600, then pulls the handle 600 forward toward the rails 140, 150, and then lowers the rails 140, 150 to the desired incline. The handle 600 is operably coupled to latch 611 in the tower 120 to lock/unlock the position of the carriage 130. The handle 600 includes a plate 612 with a hole 613 that receives an actuation lever pin 614. A cam tube 615 rotates about off-axis pivot bolt 616, causing actuation lever pin 614 to move within directing slot 617 of top tower plate 618. The off-axis rotation of cam tube 615 causes lever 619, which receives tube 615, to move towards (or away from) the rails 140, 150. Pulling of the handle 600/rotation of the tube 616 towards the rails 140, 150 causes latch 611, which is welded to lever 619 to move outward, and disengage slot 622 (to unlock the position of the carriage 130) and releasing of the handle 600/spring-biased rotation of the tube 616 away from the rails 140, 150 causes latch 611 to move inward, and engage slot 622 (to lock the position of the carriage 130). Springs respectively bias the handle 600, tube 616, and latch into a home position and inhibit play/rattling in the handle 600, tube 616, and latch 62. The user can always raise the rails 140, 150 by lifting them from any convenient hand hold position, including lifting via the arms 220A, 220B and/or via the carriage 130;

6) With reference to FIGS. 16A *and* 16B, an embodiment of a carriage lock mechanism 650A includes a carriage lock pin 651 that engages a hole on a rear face of slidable carriage cuff 670 for locking the carriage 130 to the tower 120. FIG. 16B illustrates the lock pin 651 stored in a hole on a top face of the carriage 130. The carriage lock pin 651 allows a user to lift the tower 120 from the back 670 for moving the inclinable exercise device 100A, 100B, 100C, 100D in a room; and/or 7) The user support platform/glideboard 210 is a tilting glideboard 210.

Figure 17A:
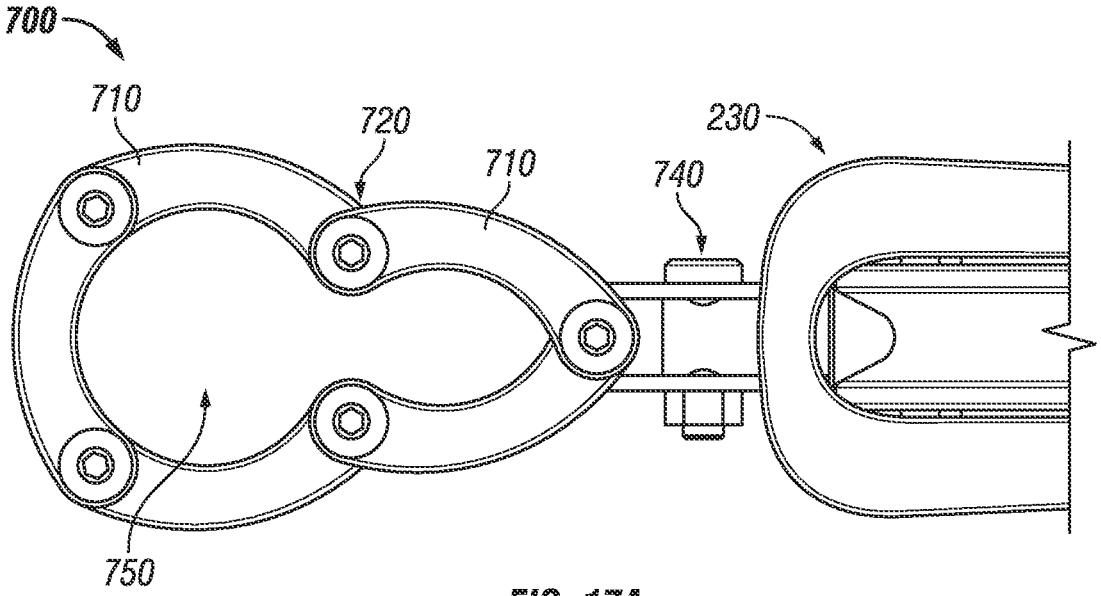
FIGS. 17A-17C are elevational, perspective, and partial cross-sectional views of a pulley locator clamp.
Figure 17B:
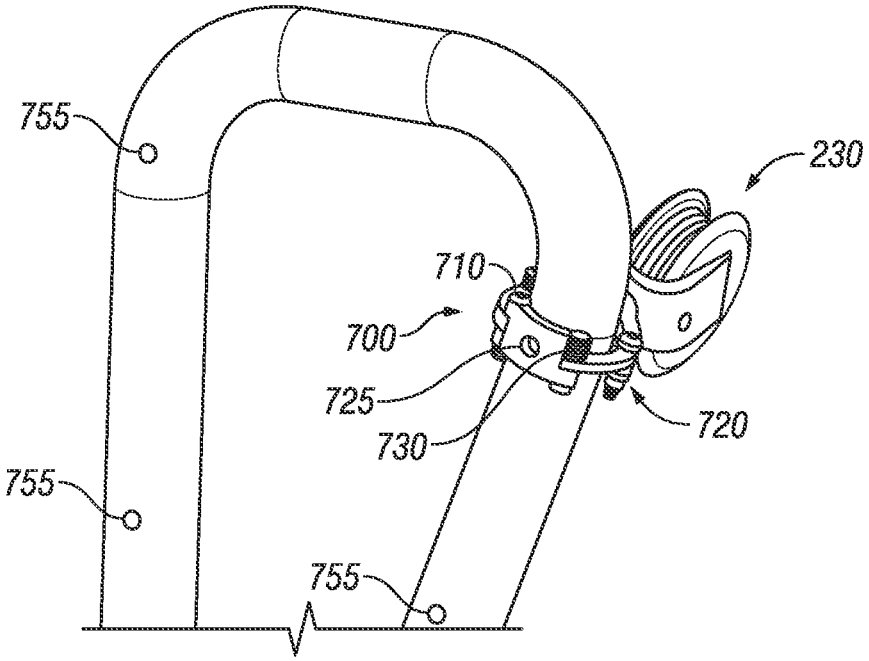
Figure 17C:
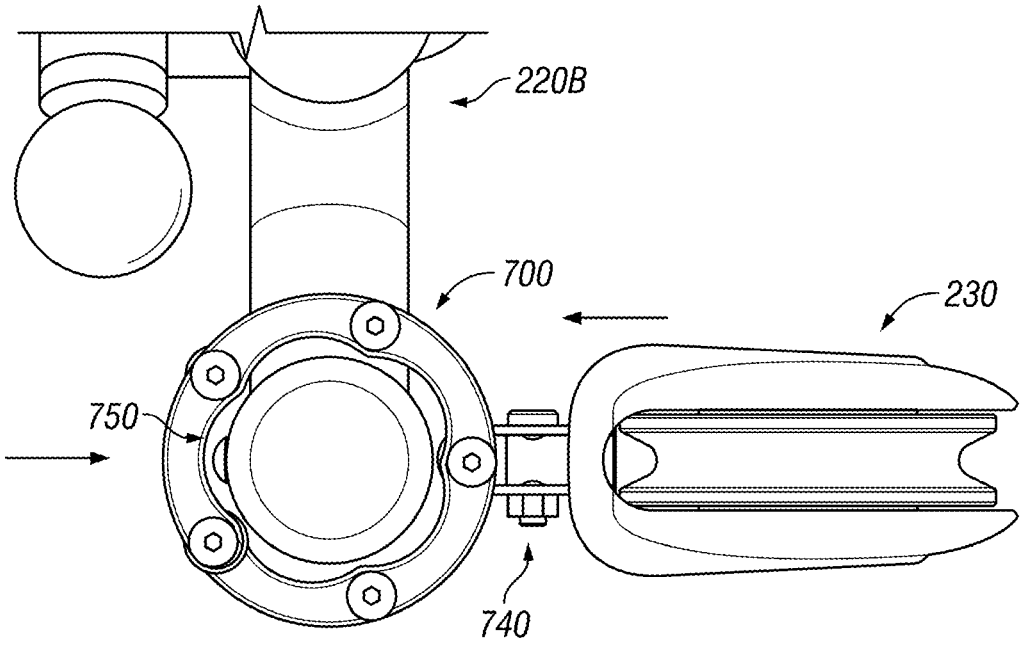

With reference to FIGS. 17A-17C, a pulley locator clamp 700 clamps the pulley 230 to rubber-coated bar/arm 220A, 220B. The pulley locator clamp 700 includes a series of curved arms/members 710 that are connected to each other at pivots/fasteners 720. Main curved member 710 includes a receiving hole 725. Torsion springs 730 urge the pulley locator clamp 700 to the position/configuration shown in FIG. 17A. A connector 740 attaches the pulley locator clamp 700 to the pulley 230. As shown in FIG. 17C, when inner and outer points of the pulley locator clamp 700 are squeezed together, circular hole 750 is formed with a diameter greater than the diameter of the bar/arm 220A, 220B, allowing the pulley locator clamp 700 (and pulley 230) to be moved over the bar/arm 220A, 220B to a desired location over bump 755 extending from the bar/arm 220A, 220B. Once in the desired location, the inward pressure on the pulley locator clamp 700 is released and the springs 730 urge the clamp 700 onto the bar/arm 220A, 220B so that the receiving hole 725 of the main curved member 710 receives the bump 755. The clamp 700 tightens further on the bar/arm 220A, 220B as it is loaded from exercising.

Figure 1F:
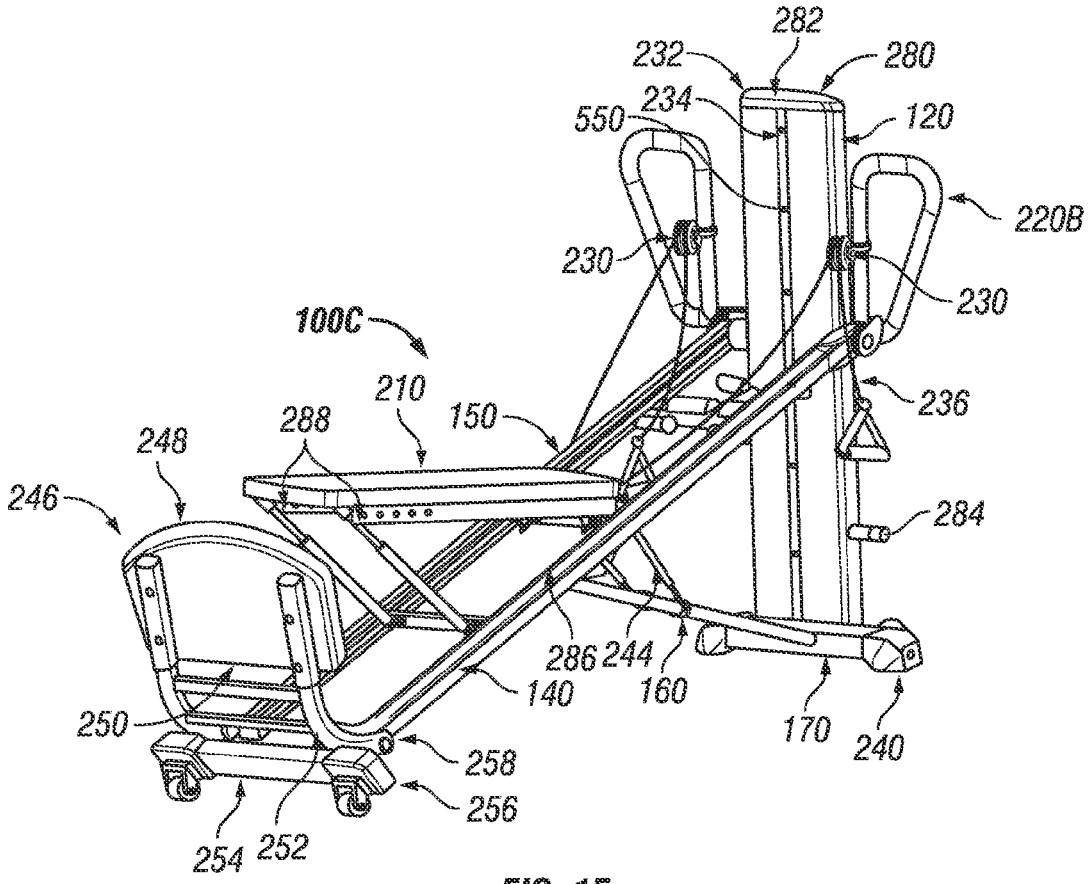
FIGS. 1F and 1G are perspective views of another embodiment of a collapsible inclinable exercise device shown in FIG. 1A.
Figure 1G:
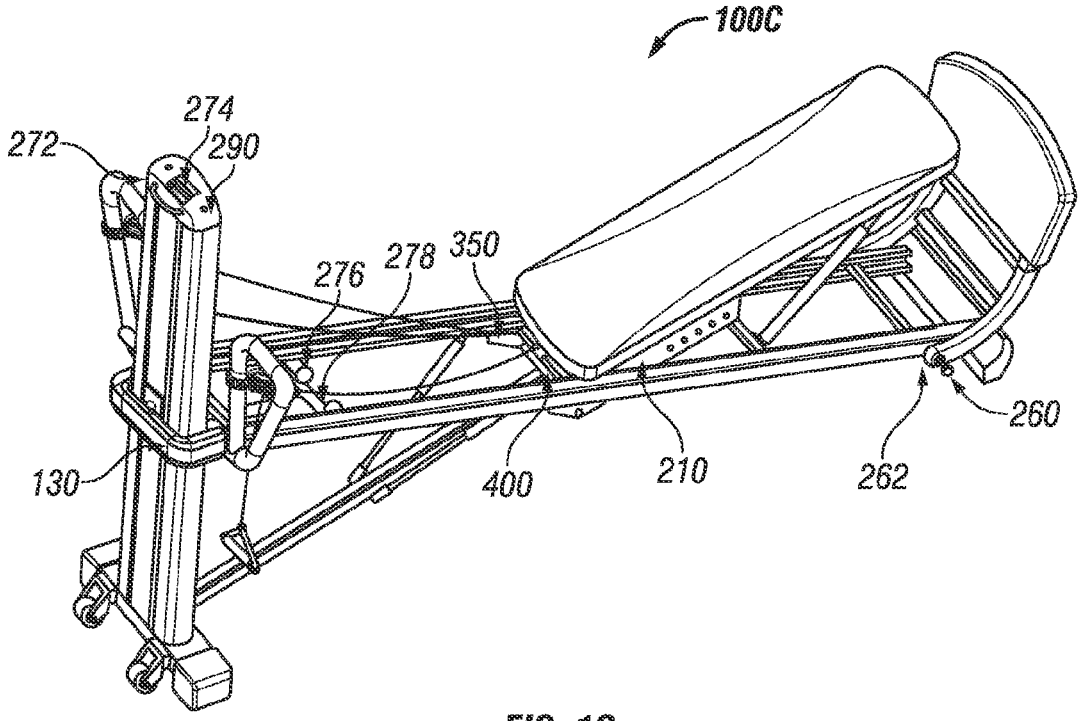

FIGS. 18A-18D show resistance chart information/tables for a method of using the exercise device 100A, 100B, 100C, 100D. The resistance chart information/tables in FIGS. 18A, 18B are for a fixed/flat glideboard 210 as shown in FIGS. 1B-1E and the resistance chart information/tables in FIGS. 18C, 18D are for an adjustable glideboard 210 as shown in FIGS. 1F-1G. The method includes selecting a body weight from the table, selecting a maximum resistance level from the table, determining an incline level from the table based on the selected body weight and maximum resistance level, inclining the rails 140, 150 of the exercise device 100A, 100B, 100C, 100D to the determined level, and using the exercise device 100A, 100B, 100C, 100D.

Another method of using the exercise device 100A, 100B, 100C, 100D includes selecting a body weight from the table, selecting at least one of a body weight percentage and an incline level from the table, and determining a maximum resistance level from the table based on the selected body weight and the at least one of the body weight percentage and the incline level, inclining the rails 140, 150 of the exercise device 100A, 100B, 100C, 100D to the selected level, and using the exercise device 100A, 100B, 100C, 100D.

A further method involves a method of using an exercise device 100A, 100B, 100C, 100D. The exercise device includes one or more features shown and/or described herein. For example, but not by way of limitation, the exercise device includes a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline; first and second pulleys coupled to the adjustable incline; and one or more cables extendable through first and second pulleys and coupled to the user support platform for movement of the support platform along the adjustable incline through cable movement. The method includes selecting a body weight from one or more of the tables shown in FIGS. 18A-18D, selecting a maximum resistance level from one or more of the tables, determining an incline level from one or more of the tables based on the selected body weight and maximum resistance level, inclining the rails 140, 150 of the exercise device 100A, 100B, 100C, 100D to the determined level; and a user mounting the user support platform and engaging the exercise device for performance of exercise training according to the selected body weight, selected maximum resistance level, and determined incline level.

A still further method involves a method of using an exercise device 100A, 100B, 100C, 100D. The exercise device includes one or more features shown and/or described herein. For example, but not by way of limitation, the exercise device includes a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline; first and second pulleys coupled to the adjustable incline; and one or more cables extendable through first and second pulleys and coupled to the user support platform for movement of the support platform along the adjustable incline through cable movement. The method includes selecting a body weight from one or more of the tables shown in FIGS. 18A-18D, selecting at least one of a body weight percentage and an incline level from one or more of the tables, and determining a maximum resistance level from the one or more of the tables based on the selected body weight and the selected at least one of the body weight percentage and the incline level, inclining the rails 140, 150 of the exercise device 100A, 100B, 100C, 100D to the selected level; and a user mounting the user support platform and engaging the exercise device for performance of exercise training according to the selected body weight, selected at least one of the body weight percentage and the incline level, and determined maximum resistance level.

Figure 19A:
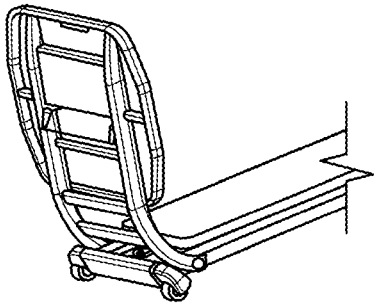
FIGS. 19-A-19I are perspective views of embodiments of a number of accessories for the exercise device.
Figure 19B:
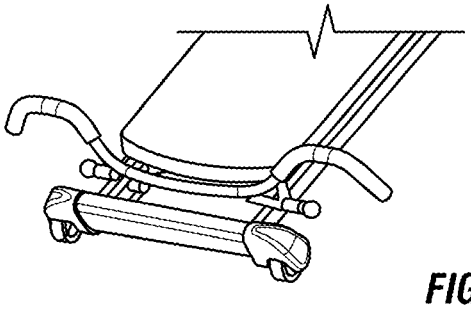
Figure 19C:
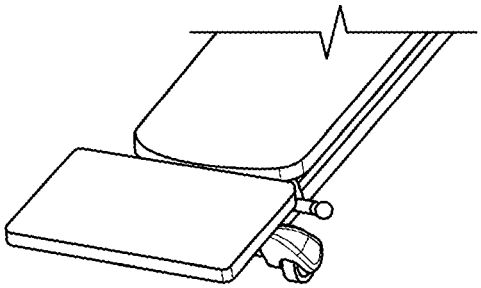
Figure 19D:
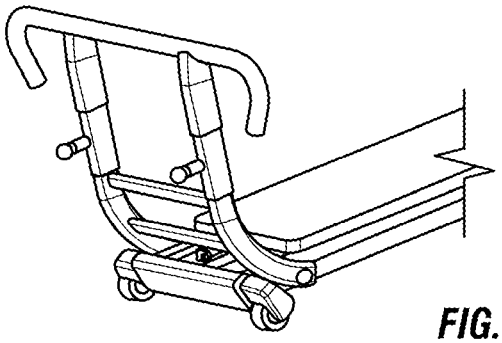
Figure 19E:
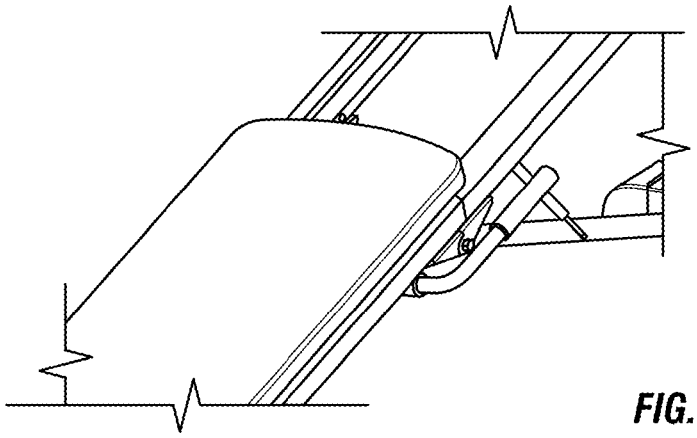
Figure 19F:
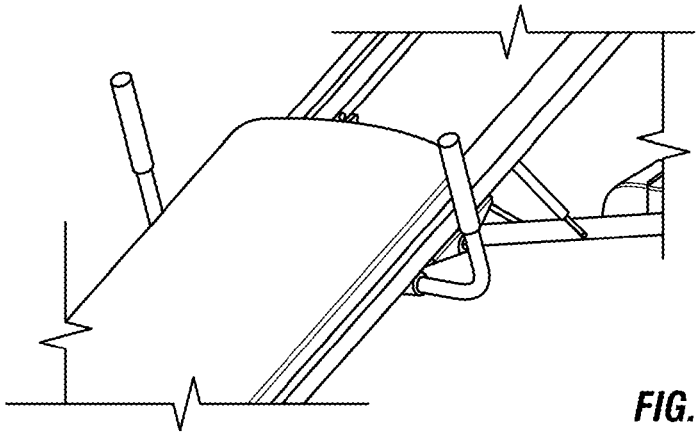
Figure 19G:
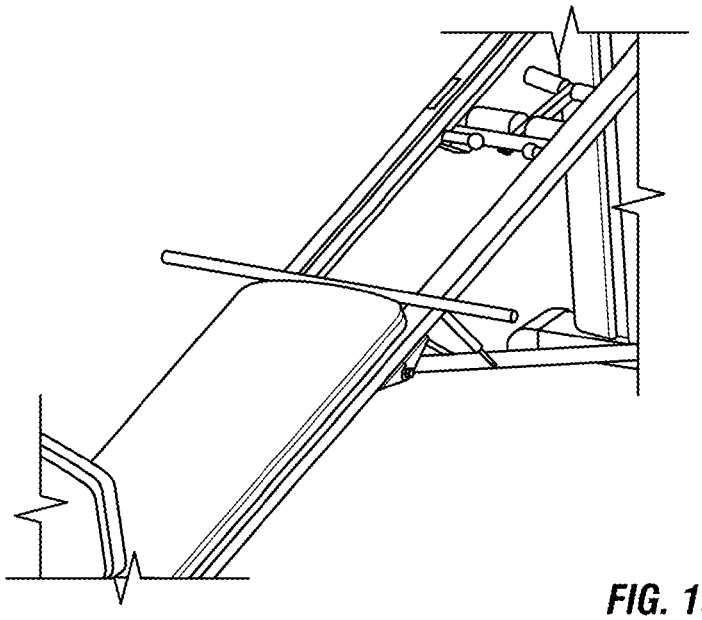
Figure 19H:
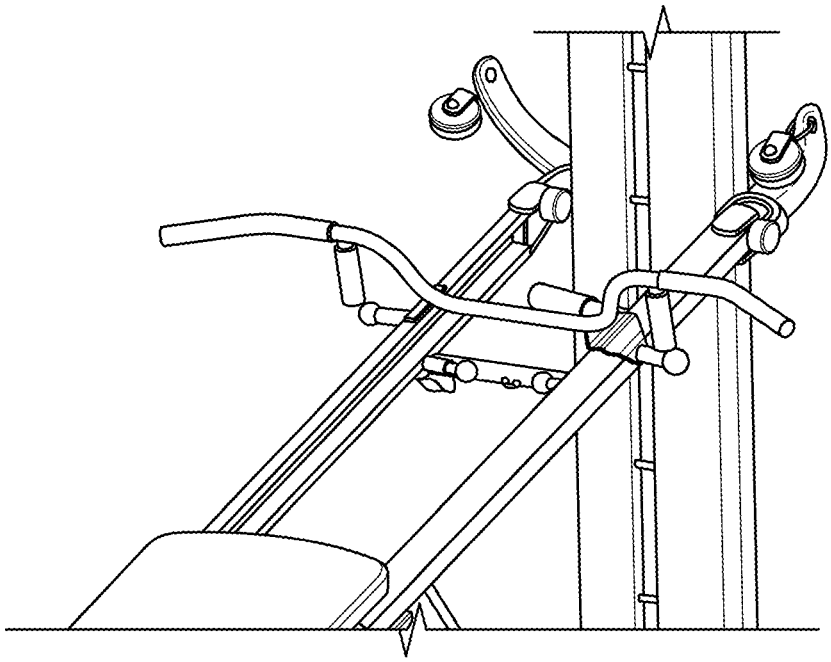
Figure 19I:
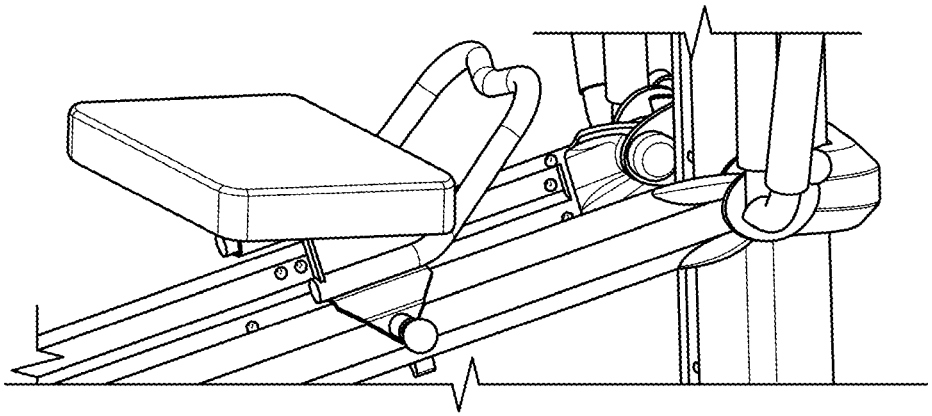

FIG. 19A (closed chain platform/BAPS attachment), FIG. 19B (press bar), FIG. 19C (foot stand), FIG. 19D (toe bar), FIGS. 19E/19F (squat handle bar, grip bar, slide distance regulator, dip bar), FIG. 19G (weight bar), FIG. 19H (3-grip pull-up bar), and FIG. 19I (scrunch bar/handle/platform) show embodiments of a number of accessories for the exercise device 100A, 100B, 100C, 100D. Other accessories may include, but are not limited to, a leg pulley system, an accessory rack/cart, and/or a wooden dowel. One or more implementations of the exercise device 100A, 100B, 100C, 100D, includes one or more of the accessories shown in FIGS. 19A-19I.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An exercise device, comprising:

a vertical support member;

an adjustable incline having a first end and a second end, the first end of the adjustable incline vertically movable with respect to the vertical support member for setting the incline of the adjustable incline, the adjustable incline including a top rail and a bottom rail pivotally coupled to each other at and defining a first rotational axis at a first location;

a strut with a first end and a second end, the first end of the strut being pivotally coupled to the vertical support member and the second end of the strut being pivotally coupled to the adjustable incline at and defining a second rotational axis at a second location that is not the same as the first location so that the first and second rotational axes are not collinear;

a user support platform movably attached to the adjustable incline;

first and second pulleys coupled to the adjustable incline;

one or more cables extendable through first and second pulleys and coupled to the user support platform for movement of the support platform along the adjustable incline through cable movement.

2. The exercise device of claim 1, further including a lift-assist mechanism pivotally coupled at one end to the strut and pivotally connected at an opposite end to the top rail.

3. The exercise device of claim 2, wherein the lift-assist mechanism includes a pair of push-type gas springs.

4. The exercise device of claim 2, wherein the first location is a first pivot and the second location is a second pivot that is positioned relative to the first pivot so that the lift-assist mechanism provides folding assistance when folding the rails.

5. The exercise device of claim 4, wherein the exercise device includes a third pivot where the first end of the strut is pivotally coupled to the vertical support member.

6. The exercise device of claim 5, wherein the exercise device includes a carriage that couples the first end of the adjustable incline with the vertical support member for vertical movement of the carriage and the first end of the adjustable incline relative to the vertical support member, and the exercise device includes a fourth pivot where the first end of the adjustable incline is pivotally coupled to the carriage.

7. The exercise device of claim 6, wherein the exercise device includes a four-bar linkage between the first pivot, the second pivot, the third pivot, and the fourth pivot.

8. The exercise device of claim 1, further including first and second combination pulley-support and pull-up bars pivotally coupled to the first end of the adjustable incline for movement between at least a substantially vertical position and a substantially horizontal position, slots, pull pins engageable in the slots to lock the first and second combination pulley-support and pull-up bars in the substantially vertical position, and cam mechanisms that cause the pull pins automatically engage the slots when the first and second combination pulley-support and pull-up bars are pivoted upward from the substantially horizontal position to the substantially vertical position.

9. The exercise device of claim 1, further including a rail lock mechanism that automatically locks the top rail and the bottom rail together in linear alignment at a greater incline and automatically unlocks the top rail and the bottom rail from each other, allowing the top rail and the bottom rail to pivot relative to each other about the second location at a lower incline.

10. The exercise device of claim 9, wherein the rail lock mechanism includes a latch with a cam member that is operably coupled to the strut to automatically lock the top rail and the bottom rail together in linear alignment at a greater incline and automatically unlock the top rail and the bottom rail from each other, allowing the top rail and the bottom rail to pivot relative to each other about the second location at a lower incline.

11. The exercise device of claim 1, wherein the adjustable incline includes inside tracks and the user support platform includes rollers that rollably couple the user support platform to the adjustable incline along the inside tracks.

12. The exercise device of claim 11, wherein the rollers includes a soft rolling member and a flange.

13. The exercise device of claim 1, wherein the vertical support member includes a rear and the exercise device includes a carriage that couples the first end of the adjustable incline with the vertical support member for vertical movement of the carriage and the first end of the adjustable incline relative to the vertical support member, a carriage lock mechanism that locks the carriage relative to the vertical support member, and a pin that locks the carriage lock mechanism along the rear of the vertical support member so that a user can lift the vertical support member from a rear of the vertical support member for transporting the exercise device.

14. The exercise device of claim 1, wherein the exercise device includes a carriage that couples the first end of the adjustable incline with the vertical support member for vertically movement of the carriage and the first end of the adjustable incline relative to the vertical support member, a carriage lock mechanism that locks the carriage relative to the vertical support member, and the vertical support member includes a top with a handle operably coupled to the carriage for unlocking the carriage relative to the vertical support member.

15. The exercise device of claim 1, further including first and second combination pulley-support and pull-up bars pivotally coupled to the first end of the adjustable incline, and pulley locator clamps that couple the first and second pulleys to the first and second combination pulley-support and pull-up bars, the pulley locator clamps including multiple curved members pivotally attached together in a closed loop in both an open and closed configuration and including a biasing mechanism that urges the curved members towards each other.

16. The exercise device of claim 15, wherein the first and second combination pulley-support and pull-up bars include multiple bumps spaced thereon and the pulley locator clamps each includes a hole that receives one of the bumps on a respective one of the combination pulley-support and pull-up bars for positioning and securing the pulley locator clamps on and to the first and second combination pulley-support and pull-up bars.

* * * * *